United States Patent [19]

Keiser

[11] 3,941,228

[45] Mar. 2, 1976

[54] ELECTROMAGNETICALLY OPERATED PRINTER

[75] Inventor: Fritz Keiser, Ebmatingen, Switzerland

[73] Assignee: Firma Precisa AG. Rechenmaschinenfabrik, Zurich, Switzerland

[22] Filed: June 10, 1974

[21] Appl. No.: 478,343

[30] Foreign Application Priority Data

June 13, 1973 Germany ..... 2330086
Apr. 19, 1974 Germany ..... 2419020

[52] U.S. Cl. ..... 197/18; 101/93.15; 101/93.18; 101/93.25; 197/55

[51] Int. Cl.[2] ..... B41J 23/04; B41J 1/32

[58] Field of Search ..... 197/18, 55, 49, 53; 101/93; 178/34; 235/58, 61.9 A

[56] References Cited

UNITED STATES PATENTS

| | | | |
|---|---|---|---|
| 1,788,376 | 1/1931 | Barrett | 235/58 CF |
| 2,064,203 | 12/1936 | Garbell | 235/58 CF |
| 2,341,630 | 2/1944 | Lambert | 235/58 CF |
| 2,905,302 | 9/1959 | Hickerson | 197/52 |
| 2,923,394 | 2/1960 | Frieberg et al. | 235/58 CF X |
| 3,168,182 | 2/1965 | Bernard et al. | 197/55 |
| 3,227,259 | 1/1966 | Howard | 197/49 |
| 3,247,941 | 4/1966 | Beattie et al. | 197/55 |
| 3,378,127 | 4/1968 | Clary et al. | 197/55 |
| 3,526,309 | 9/1970 | Marion et al. | 197/49 X |
| 3,605,978 | 9/1971 | Kawano | 197/55 |
| 3,608,692 | 9/1971 | Henry | 178/34 X |
| 3,616,888 | 11/1971 | Kawano et al. | 197/55 X |
| 3,647,040 | 3/1972 | Waldenburger et al. | 197/55 X |
| 3,695,410 | 10/1972 | Kapp | 197/55 |
| 3,739,897 | 6/1973 | Pateuk et al. | 197/55 |
| 3,739,898 | 6/1973 | Rooney | 197/55 |
| 3,743,073 | 7/1973 | Perez | 197/55 |
| 3,773,159 | 11/1973 | Koller | 197/49 |
| 3,837,457 | 9/1974 | Anglin et al. | 197/18 |

*Primary Examiner*—Edgar S. Burr
*Assistant Examiner*—Paul J. Hirsch
*Attorney, Agent, or Firm*—Burns, Doane, Swecker & Mathis

[57] ABSTRACT

A printer, suitable for operation by an electric computer, includes a traveling carriage. The carriage carries a type-head that is vertically and rotatably shiftable to properly orient a type element for printing. Movement of the carriage, as well as vertical and rotary movement of the type-head is produced by the use of cables actuated by electromagnets. The type-head is selectively shiftable to three vertically spaced positions and selectively rotatable to eight angular positions by vertically movable levers having cables controlling their ends. Stops are provided on the carriage for precisely locating the type-head in its vertical and angular positions.

A movable stop mechanism prevents the carriage from overrunning its incremental positions of step-by-step movement. Release of the carriage drive to retract the carriage to a new starting position is accomplished by activation of the platen advancing mechanism.

34 Claims, 30 Drawing Figures

ELECTROMAGNETICALLY OPERATED PRINTER

BACKGROUND AND OBJECTS OF THE INVENTION

The invention relates to a serial printer for electronic table computers and the like, the printer being of a kind having a type carrier movable step-by-step parallel to a movable platen.

Serial printers of a known type, which are used for typing the values fed into a computer or the results of these calculations, are, generally, motor-driven. As a result, a relatively high mechanical expenditure for the drive of the type-selection, the advance of the carriage carrying the type carrier, the printing movement, etc. will be necessary. Such printers can have about 500 individual parts, so that both the production costs of such a large number of parts as well as the costs for their assemblage are high. Furthermore, the entire mechanism is sensitive to breakdowns, and subject to noise and considerable wear. Beyond that, the writing speed of such printers is limited to an unsatisfactorily low value, because of the complicated transmission mechanism and because of the fact that the selection control of the types must always start out from a base position.

It is an object of the present invention to minimize or obviate problems of these types.

It is another object of the invention to improve a serial printer of the initially-described type in such a way that the number of individual parts will be decreased to a fraction, enabling the parts to become much more simplified.

It is a further object to enable the printer to operate more quickly and noiselessly, be largely free of maintenance, and show the least possible wear of the moving parts.

It is yet another object to enable the values emitted from a table calculator in the binary system, without conversion, to be addressed directly as control commands for the selection of type indicia.

BRIEF SUMMARY OF A PREFERRED EMBODIMENT OF THE INVENTION

The solution of these and other objects takes place according to the invention through the fact that all adjusting forces, such as those for (1) the feed of a conveying carriage carrying a type carrier that is formed as a type-head, (2) the twisting of the type-head around its axis, and (3) the vertical shifting of the type-head for the purpose of type selection, and (4) the drive of a hammer striking the platen with the type-head, are produced by electromagnets attached stationary on a base frame of the printer. These forces are transferred to the carriage by means of elongate flexible connectors, such as rope, held tightly and guided by way of guide rollers.

Because of the number of types required is not particularly large, it is of advantage to develop the type-head as a type cylinder. The cylinder is provided with eight different positions of the rotational angle in equal angular distances, as well as three positions in height in an axial direction. Thus, 24 variable printing positions result, which in case of the ten numbers 0 to 9, a comma and several symbols for the designation of the calculation process, or of the result, will be quite sufficient.

The vertical lifting movement of the type cylinder can take place in three steps. The type cylinder has a shaft which is connected vertically unshiftably with the center of a lifting bridge. The lifting bridge is guided in the carriage and is shiftable counter to a spring acting vertically in a downward direction. At the ends of this bridge rope pulleys are seated, the ropes of which are each connected with an electromagnet. In its lowest position, the cylinder lifting bridge can be supported by the plate for the support of the carriage. In order to lift the type cylinder to the first lifting step, it will then suffice to energize one of the electromagnets, so that the cylinder-lifting bridge will assume a kind of diagonal position. If the type cylinder is then to be raised to the second lifting step, the second electromagnet is energized additionally so that the cylinder-lifting bridge now is again horizontal, but in the topmost position, by way of the corresponding rope and the second pulley. As a result of that, the type cylinder shaft connected with the center of the cylinder-lifting bridge has been lifted in two equal steps.

In order to decrease friction, particularly in case of rotation of the cylinder around its axle, a ball bearing has been firmly placed on the cylinder shaft. The outside bearing ring of the bearing is embedded vertically unshiftably in a block connected with the cylinder lifting bridge. A guide of the shaft itself, and thus a resistance to the rotational movement during adjustment to the various angular positions, is thus omitted. The outside ring of the bearing moreover is kept in its position away from the typing roller by an elastic return band. The type cylinder, during the printing stroke, is knocked by the hammer and against the platen counter to the return force of the elastic band.

In order to obtain a clear print of the type that has been selected, a ratchet wheel is placed firmly onto the type cylinder shaft. The wheel has V-shaped recesses, corresponding exactly to the number and direction of the type positions on the periphery of the cylinder. A guide V-spline is mounted on the carriage. This spline is opposite the ratchet wheel at a set distance and extends along the entire length of the type cylinder shaft in front of the platen. During the impact of the types against the platen, the spline fits into the recesses of the ratchet wheel to assure proper type alignment. Therefore, a clear print of numbers and symbols will be achieved, without any need for extremely close tolerance of the transfer mechanism in the regulating gear unit. The transfer mechanism, therefore, works easily and thus can be shifted quickly. Thus it is also possible to use relatively weak return forces which has a favorable effect on the adjusting speed and the size of the magnets.

For the purpose of simplifying the switching mechanism, a switching mechanism is provided advantageously which rotates the type cylinder from a basic position for numbers, counter to the force of a reversing spring, into a basic position for symbols, which basic symbols position is offset by 180° in relation to the basic numbers position.

As long, however, as symbols are to be printed (for the designation of the calculating process or of the result), the type cylinder is held in the basic position for symbols from which further rotations by three angular steps, and adjustment in two steps of height, can be accomplished. The type cylinder thus has the various symbols on one half of its jacket surface and carries the numbers on the other half of the jacket surface. The type of arrangement of the numbers, as well as of the symbols, will yet be described later in connection with the explanation of the switching processes.

Customarily, the symbol columns are written first, then follows a blank column, and after that writing of the numbers. The printer of the invention will advantageously be constructed in such a way that between the positions of the carriage for writing the symbols and the positions of the carriage for writing numbers on the paper, there is a blank step in a manner known per se. The switching arrangement for the basic positions for symbols loses its influence on the type-head, beginning with the transition to the blank step. The exact presentation will be made on the basis of an embodiment by way of example and in connection with the drawing.

The angular rotation of the type cylinder can be accomplished by a particularly simple mechanism. It has a sliding head, guided vertically shiftably in the carriage, on which a toothed rack is seated. The rack acts via a guide mechanism to rotate a gear, the gear being connected with the lower end of the type cylinder shaft to rotate the shaft and yet allow vertical shifting thereof. A shifting lever, in its middle area, is articulated on the sliding head. At the rear end of the switching lever there is mounted a swing bridge. The swing bridge is pivotal in a vertical plane located parallel to the switching lever. The swing bridge is pivoted to the switching bridge and is spring-biased downwardly. The swing bridge has one rope pulley each at both ends, across which run control ropes connected with adjusting magnets. The function of this mechanism is to rotate the type cylinder in individual steps into the eight angular positions as will be described in detail later on in connection with the drawing.

It is advantageous to provide an intermediate block, which is guided on a vertical guide bar. The intermediate block has a lateral peg fitting into an elongated hole of the shifting lever on the one hand and into a bore of the cylinder-turning bridge or swing bridge on the other hand, and represents the flexible connection between the shifting lever and the swing bridge. Through connection of the elongated hole between the shift lever and the intermediate block, the freedom of longitudinal shifting between base position shift lever and the cylinder-turning bridge is assured, which shifting is necessary to properly transmit force to the gear unit. The swing bridge itself can carry out slight horizontal balancing movements with rope pulleys seated at both ends, with which it is supported on the base plate of the carriage.

A particularly cost saving and advantageous construction will be achieved by the frame carrying the magnets. This frame has a plate of soft iron, with punched-in separating slits for the formation of upstanding yoke metal sheets. The magnet coils are placed on the plate and are encompassed by the punched-out, bent-up yoke metal sheets. Cover sheets of metal are connected to the yoke sheets above the magnets. Recesses in the cover sheets are provided to accommodate passage of the magnet armatures. The soft iron plate with the magnets constitutes a unit. A base frame unit carrying the carriage is then attached thereto. Therefore, the screwing-on of the magnet coils, and the expensive processing of a base plate necessary for it, is omitted. Beyond that, no separate yokes need be produced and attached. As an important relief in fabrication, all magnets can be the same.

In a logical continuation of the construction principle, the forces for (1) the step-by-step columnal advancement of the carriage, (2) the releasing of locks for the retraction of the carriage after a line has been written, (3) the operation of a safety mechanism for excess carriage advancement during the serial printing process, (4) the paper feed, and (5) the feed of the colored ribbon are produced by electromagnets, the magnet coils of which being located on the base plate of the printer. In the same way as in case of the drive for the type selection and the printing hammer, one will obtain a type of a drive free of a continuously switched-on motor. The drive is ready to operate and has pertinent couplings for the previously described mechanisms.

Thus, this principle for the step-by-step columnal feed of the type carriage will be realized through the fact that the pull rope, pulling the carriage counter to a return spring from the right hand stop position, is wound around a rope drum. This drum is connected rigidly with a ratchet wheel. A feed ratchet and lock ratchet, press fitted onto an axle, engage the ratchet wheel. The ratchets can be selectively disengaged for the return of the carriage. The feed ratchet is coupled with the armature of the magnet for the advance of the carriage. Every lift of this magnet causes a continued shifting of the ratchet wheel and of the rope drum by one ratchet tooth, i.e., one columnal step for the movement of the carriage. In case of a not-energized magnet, the mechanism is free of loads, but it is ready immediately for the next switching process.

In order to achieve a very quick start for the switching mechanism and a gradual deceleration toward the end of its movement, the feed ratchet is pivoted to a first, essentially horizontal lever arm of a lever plate. The lever plate is pivoted to the printer frame, on a common axis with the magnet armature. The feed ratchet can be braced with a spring against the first lever arm, while a second lever arm runs essentially downwards from the swivelling axis of the lever plate. The second lever arm carries a laterally projecting peg at its free end. This peg engages with the inside space of a brake ring, which ring is situated axially between the second lever arm and a wall of the frame, and situated horizontally between two vertical limiting strips. These strips are spaced between the outside diameter of the ring. The ring is shiftable in the direction of the limiting strips. A draw spring is inserted between the frame and a fixed point on the ring in the area of the lower arch of the ring not covered by the second lever arm. This brake ring, in cooperation with the spring and the lateral limiting strips, produces a force supporting the start of the movement, and slows down the lever deflection with gradually increasing transition up to an infinitely great force at the end of the lever path, as will be explained more precisely later on.

The step-by-step mechanism can be developed as the result of a special construction in such a way that (1) the pull ropes are kept free of excess load forces at both ends of the path of the type carriage, and that (2) the pull ropes cannot unwind from the rope drum, although heavy forces will result from the very quick return movement of the type carriage in the frame.

Also, the invention offers a solution as to how the type carriage is indeed greatly accelerated from every printing position of every column, and yet is not flung or advanced too far beyond the next printing position.

It is also possible, just like the advance of the carriage, to effect (1) a release of the carriage for the return movement after completion of the printed line, (2) the additional movements required at this moment, such as advance of the paper by one line, (3) possible advance of the colored ribbon, and (4) steps for the switching of the swing bridge for the type cylinder from a position for printing numbers into the position for printing symbols, by means of a magnet. The details needed for that as well as their function and course of mOvement will become clear from the description of an embodiment, given by way of example farther on.

Finally, an automatic paper feed can also be achieved by effective construction, without there being any need for some special mechanism and without anything also being necessary except the swinging forward of the paper guide with tear-off rail, covering up the roller place in the printer.

THE DRAWING

The invention is now to be explained in detail on the basis of the drawing with a special embodiment by way of example;

Figure 9A:
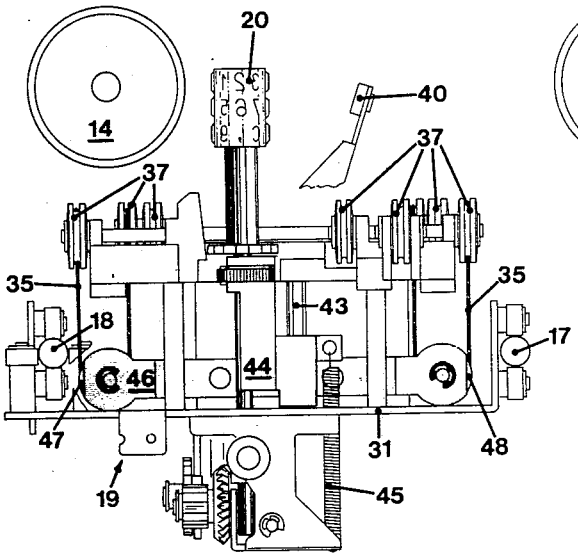
Figure 9B:
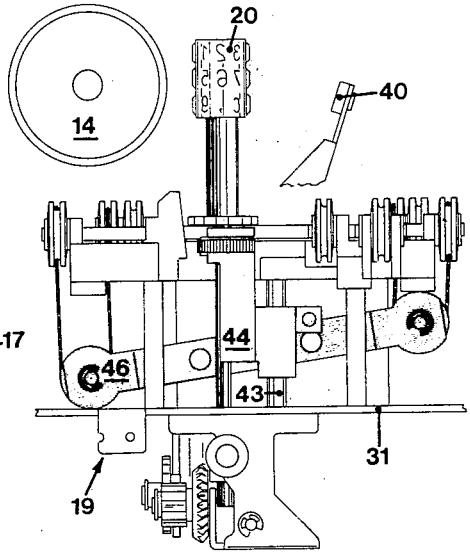
Figure 9C:
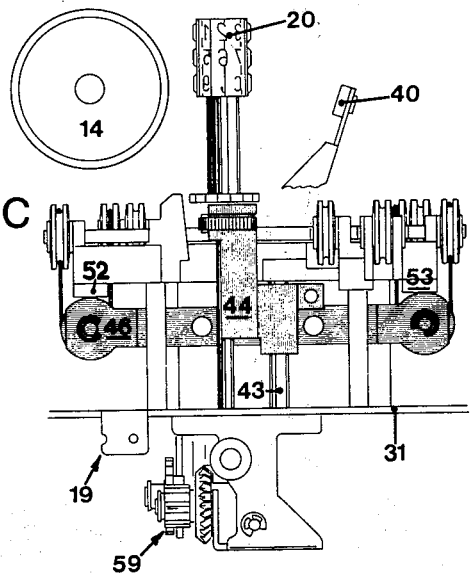
Figure 11:
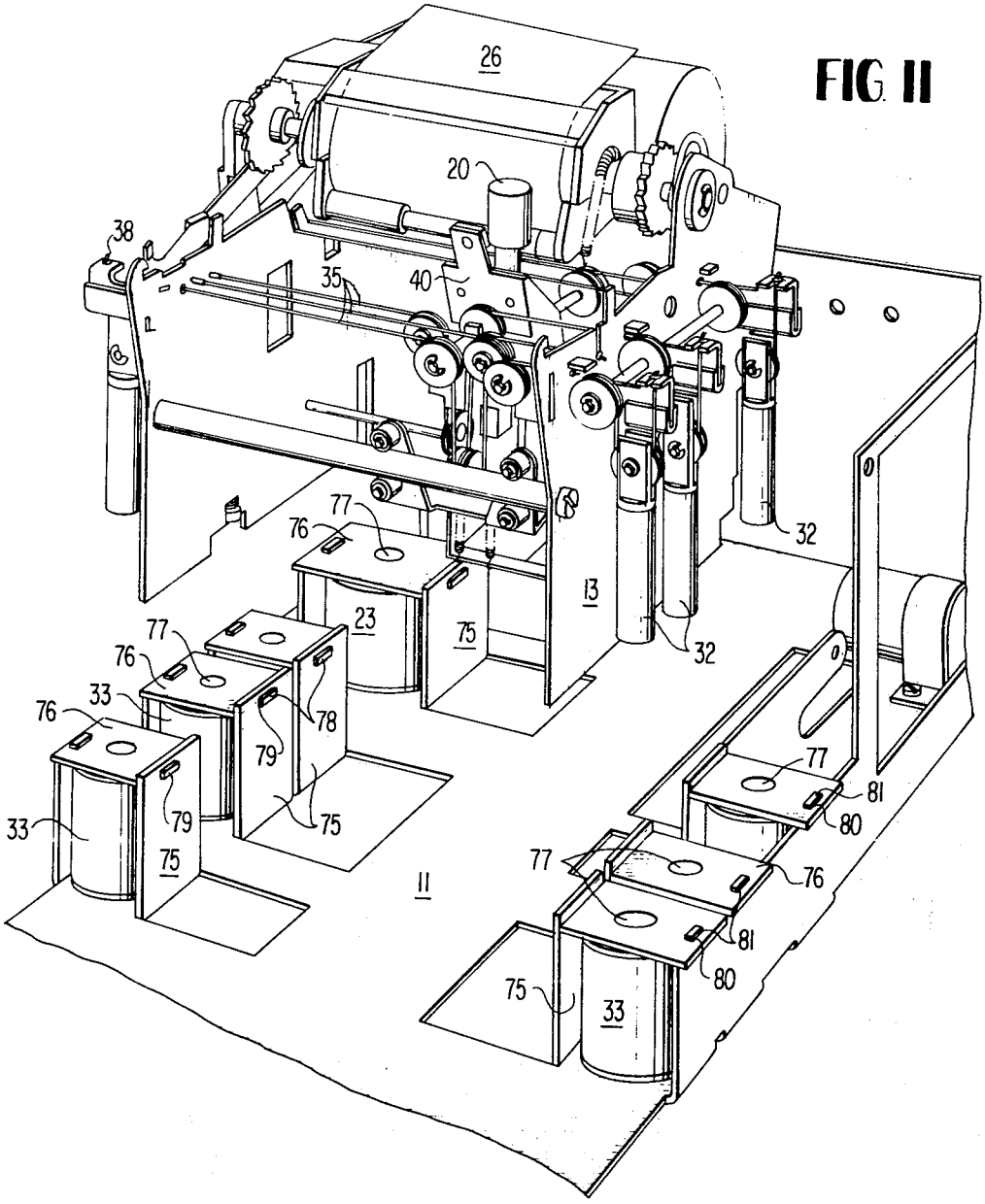
Figure 12:
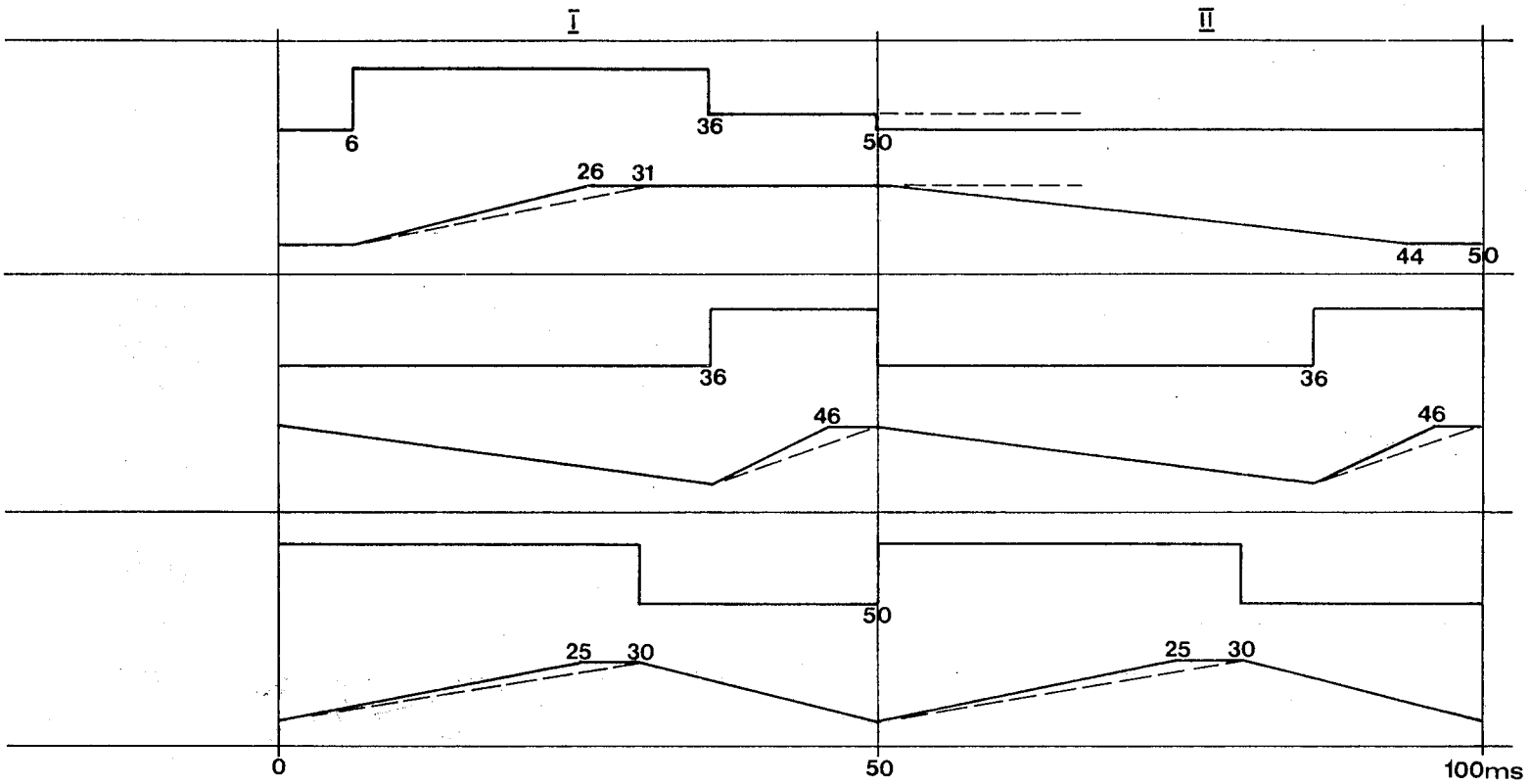
Figure 13:
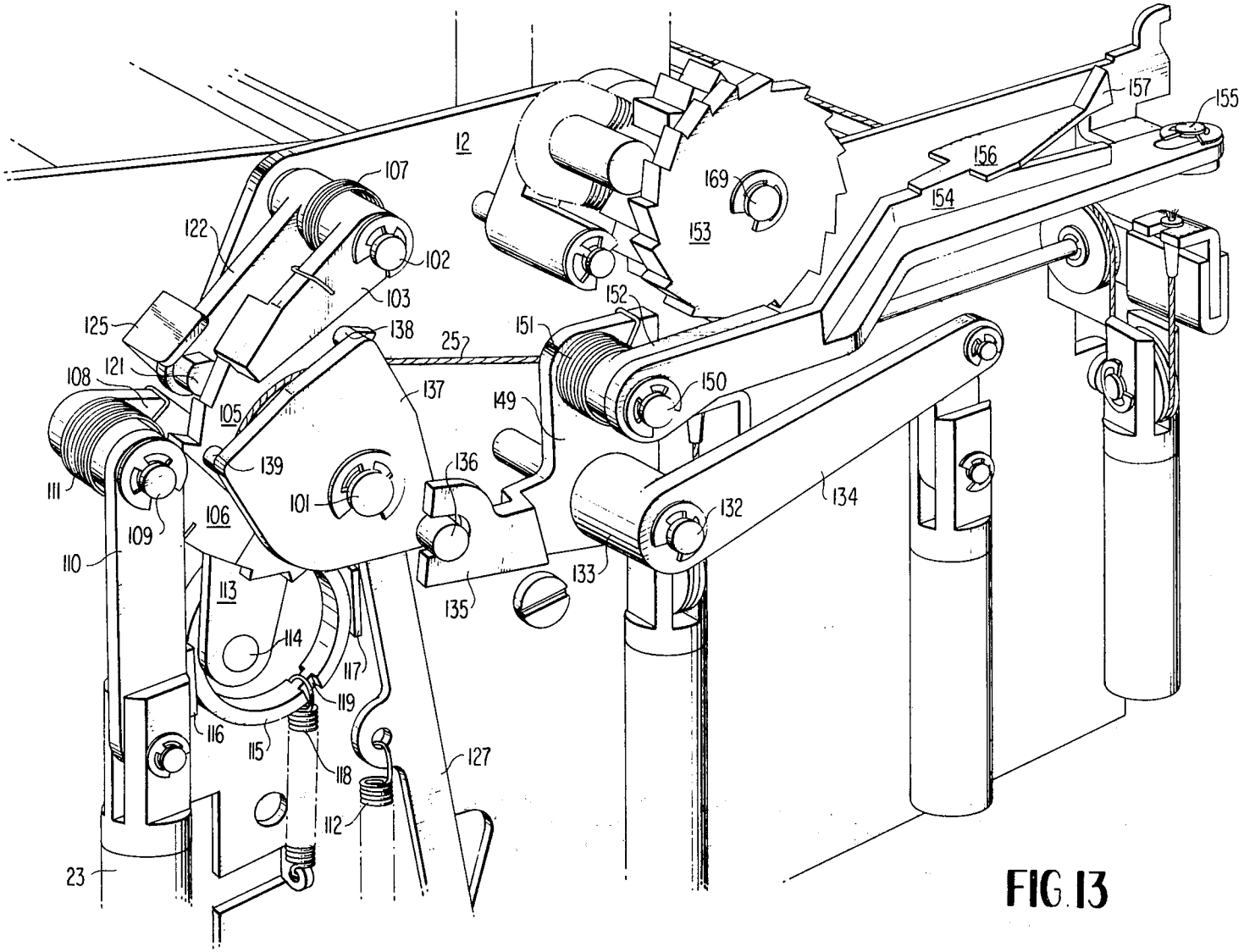
Figure 14:
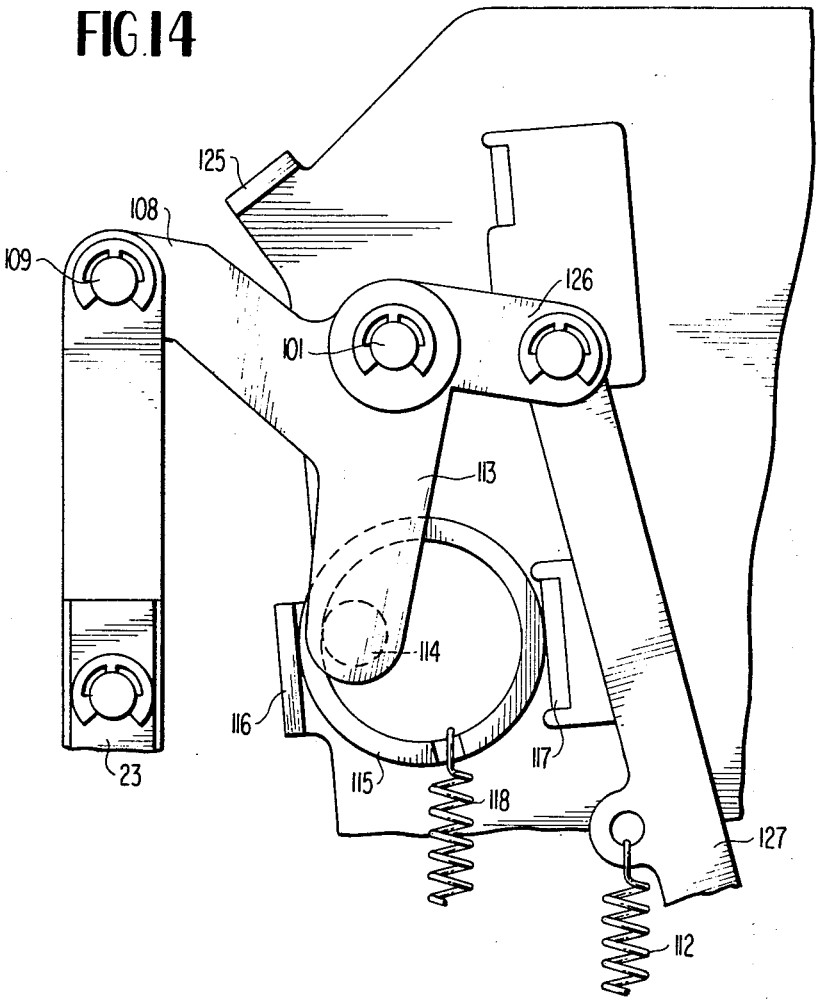
Figure 15:
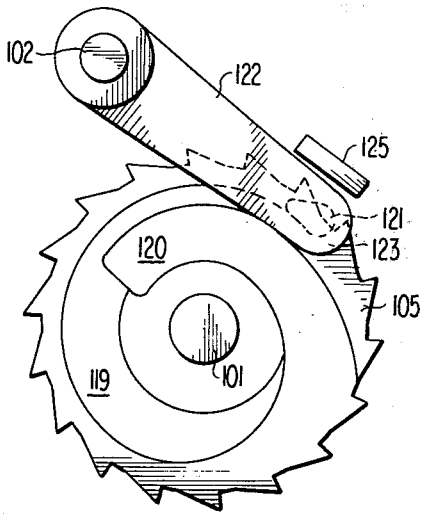
Figure 16:
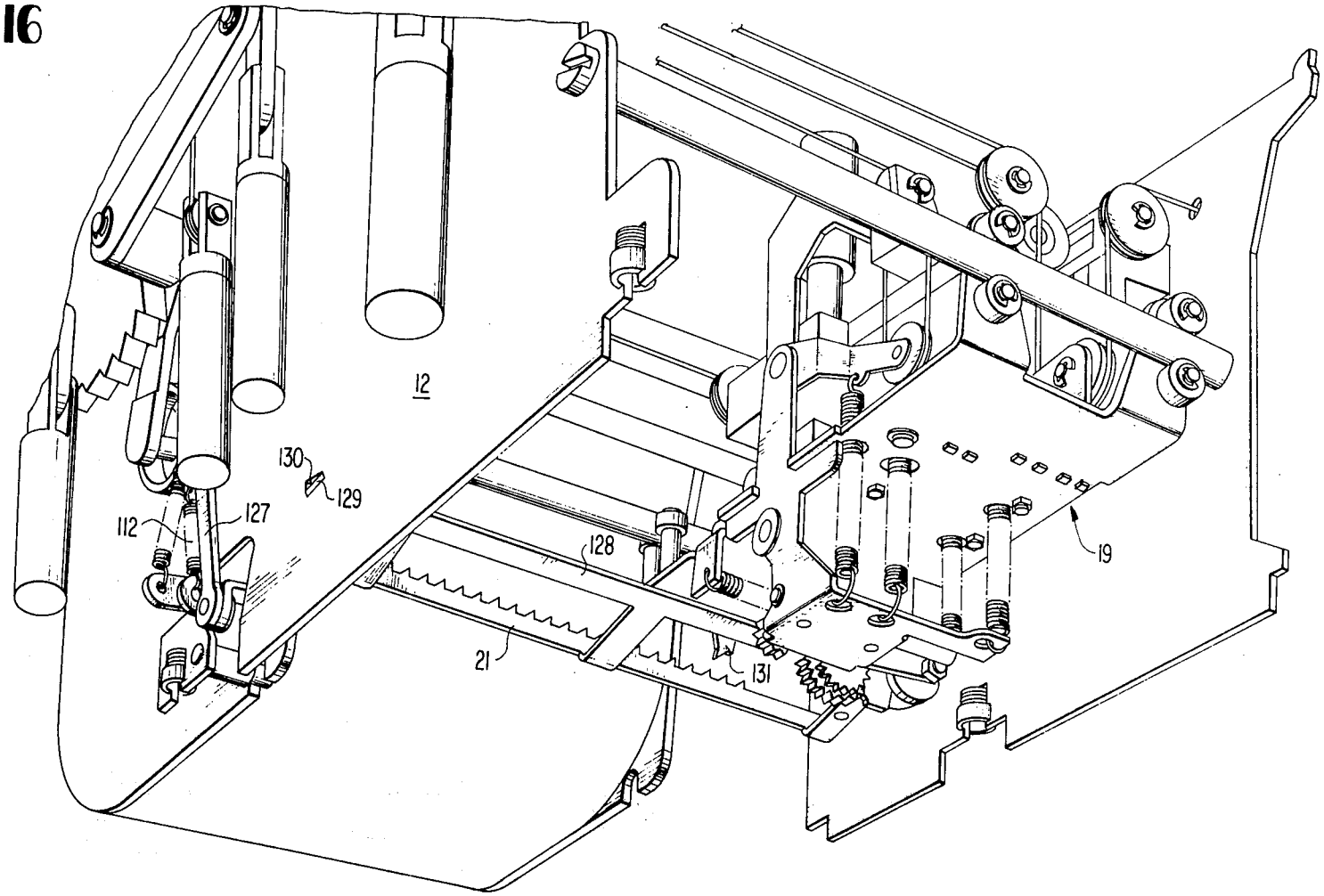
Figure 17:
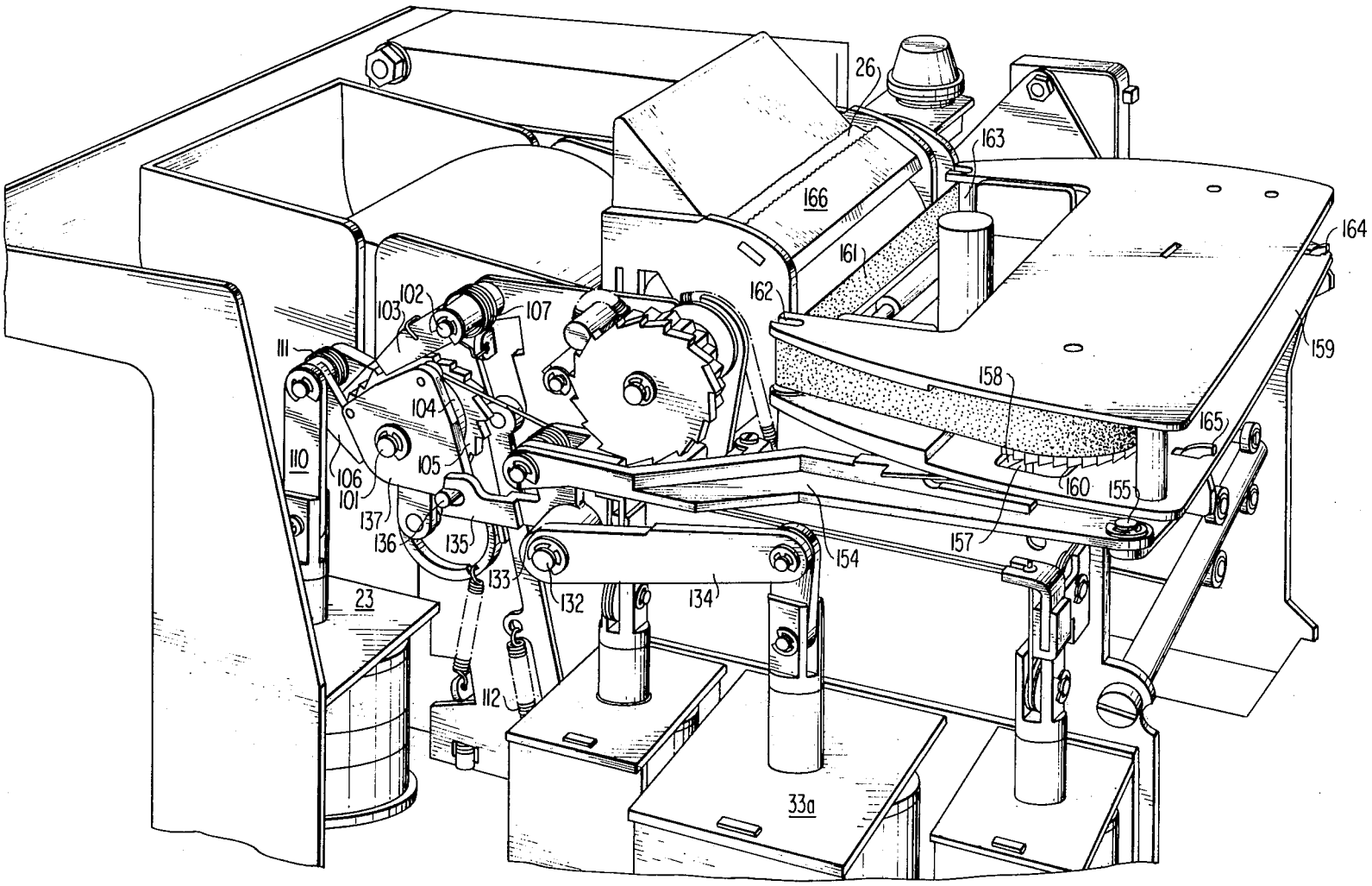
Figure 19:
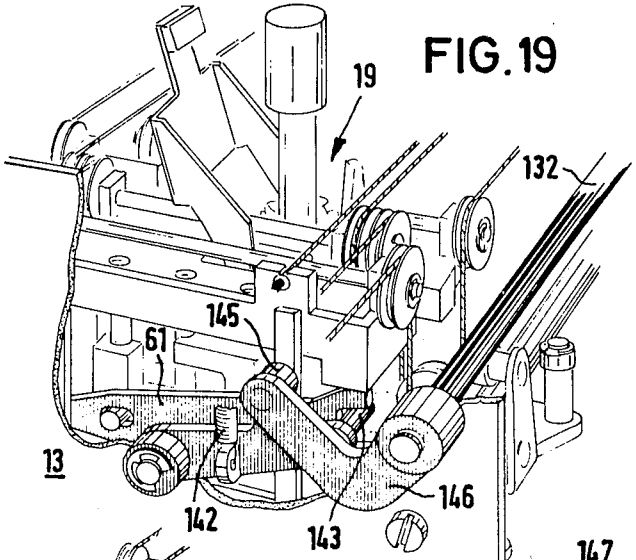
Figure 20:
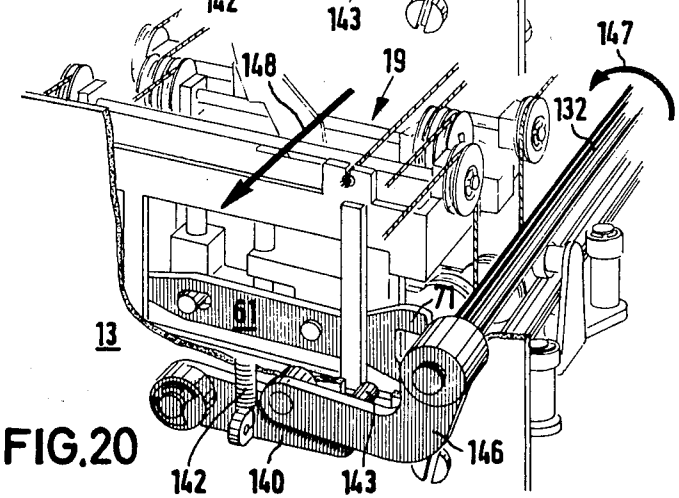
Figure 18:
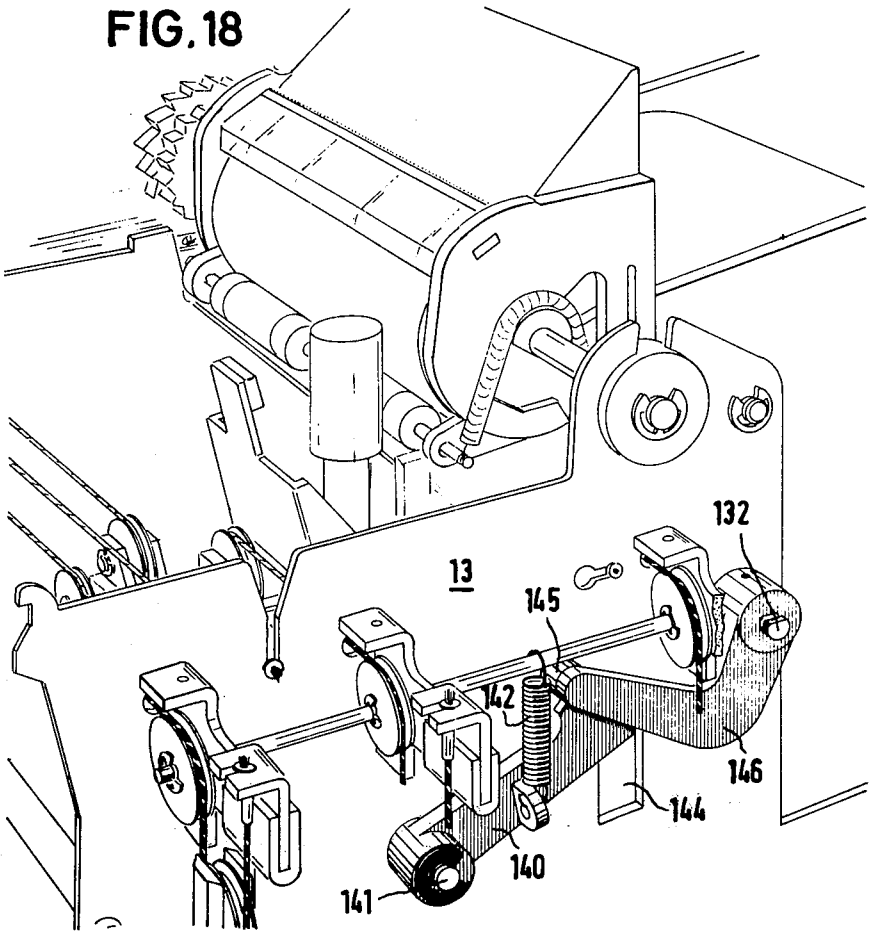
Figure 21:
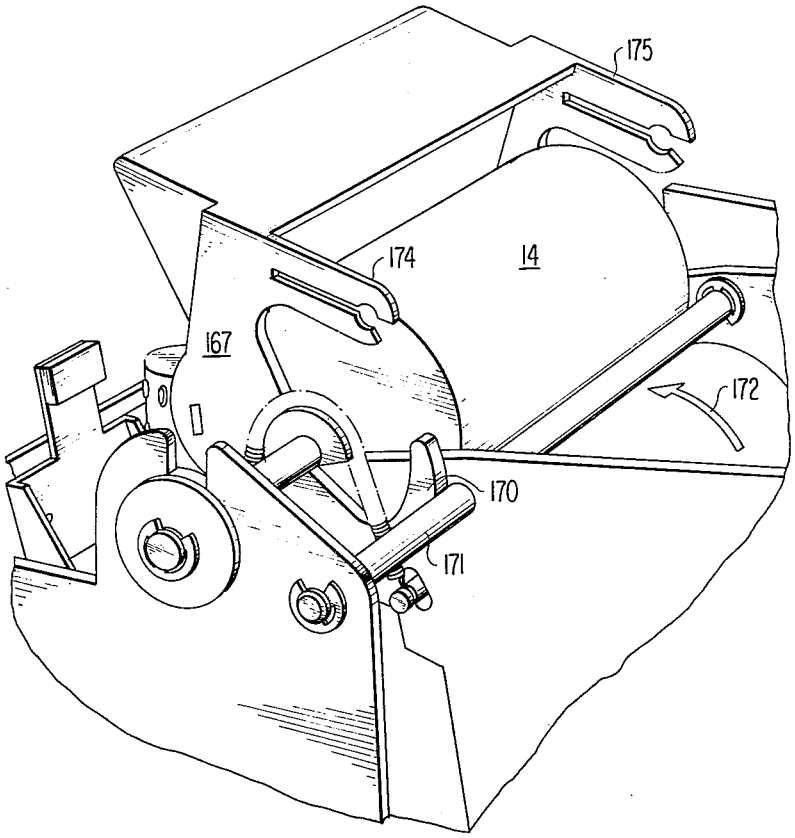
Figure 22:
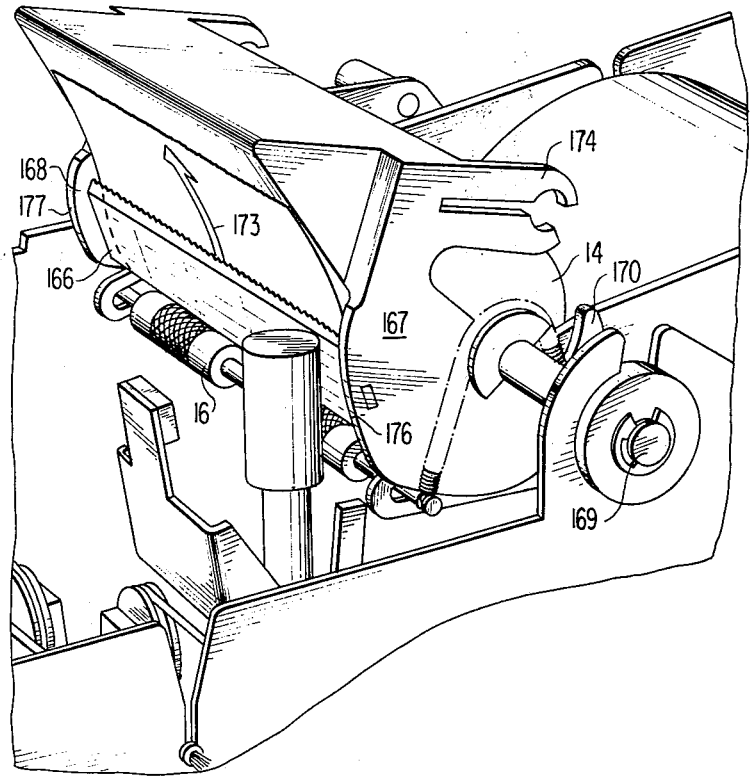

FIGS. 9*a* to 9*c* show the individual positions of the cylinder lifting bridge in case of three different positions of height of the type cylinder;

FIGS. 10*a* to 10*h* are individual presentations of the shifting lever mechanism for all eight rotating angle positions of the type cylinder;

FIG. 11 is a perspective view of the serial printer, in which the magnet unit is separated from the carriage frame;

FIG. 12 is a time diagram of the pulse sequence and of the course of movement during two printing steps at a stop sequence of 20 strokes per sec.;

FIG. 13 is a perspective top view of one side of the frame of the serial printer of the invention, in which the step shifting mechanism and means for triggering the return of the type carriage as well as the paper and ribbon feed mechanism is depicted;

FIG. 14 is the braking arrangement for the columnal step shifting mechanism in schematized presentation;

FIG. 15 is a stop mechanism of the rope drum for the pull rope moving the type carriage;

FIG. 16 is a view of the printer frame from the underside for explaining the protection against excess carriage advancement;

FIG. 17 is a perspective view of the serial printer of the invention from the same side as in FIG. 13, but with the colored ribbon box put on and with a clear stress on the mechanism releasing the rope drum for its return, as well as of the arrangements for the paper and the colored ribbon feed;

FIG. 18 shows in perspective view of one side of the printer, showing the adjusting arrangement for switching the type cylinder rotating bridge from the "number" position into the "symbol" position and vice versa;

FIG. 19 shows, with parts broken away, the same mechanism as in FIG. 18 when the switching lever for the base position is in its "symbol" position;

FIG. 20 shows again the mechanism of FIGS. 18 and 19 in its ready position for the reception of the returning type carriage; and FIGS. 21 and 22 show perspective views of the paper guide swivelled forward for introduction of a new paper strip.

DETAILED DESCRIPTION OF THE PREFERRED EMBODIMENT

Figure 1:
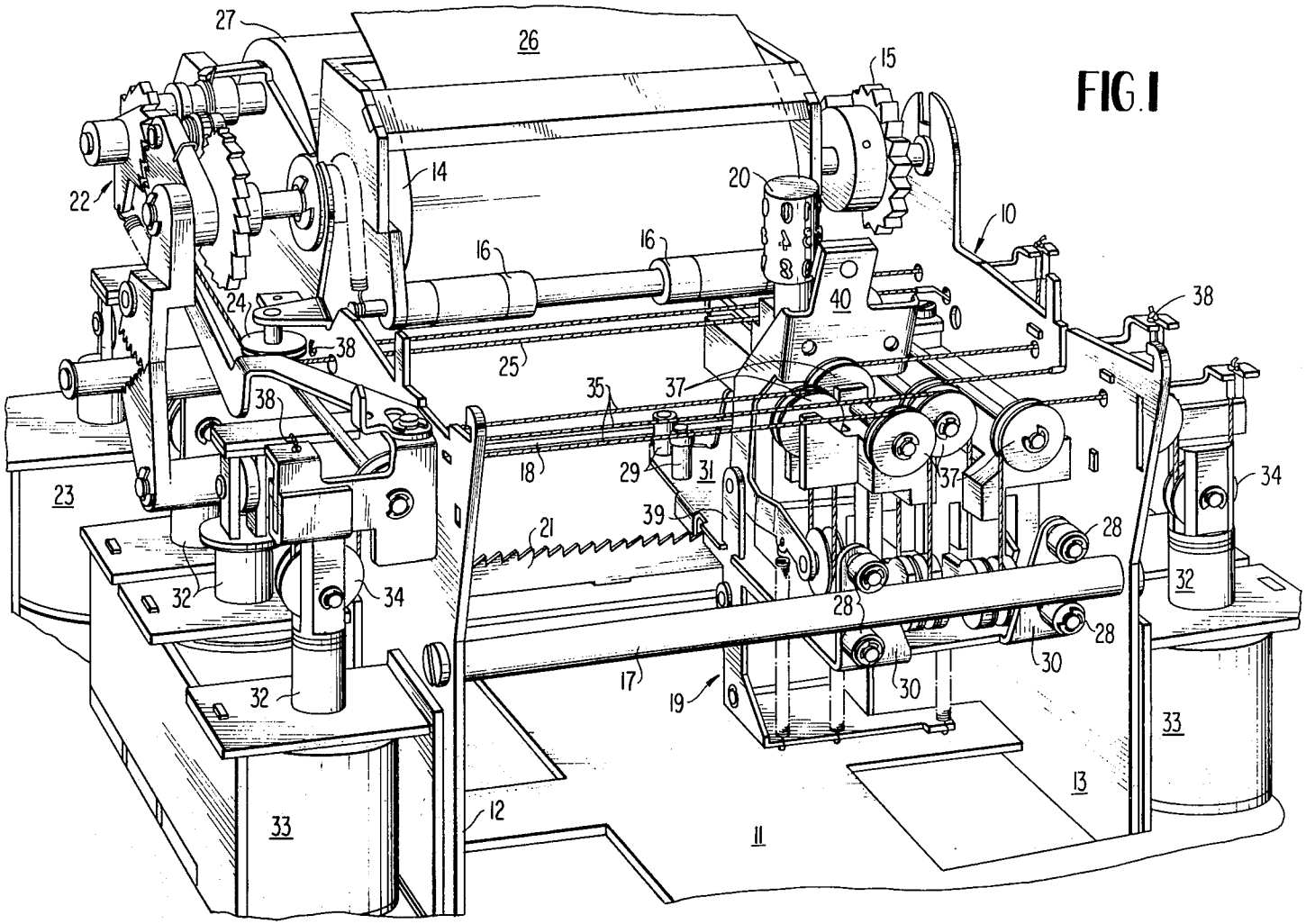
FIG. 1 shows a serial printer for an electronic table model calculator in perspective view from the direction of the writing side.

The serial printer, shown as a whole in FIG. 1, has a fixed base frame 10 which includes a base plate 11 and upstanding side walls 12 and 13 rising therefrom. Between the walls 12, 13 are operably disposed (1) a platen 14 having a stepping mechanism 15 for the paper feed, (2) pressure rolls 16 for a paper strip, (3) guide bars 17 and 18 on which travels a transport carriage 19 for a type cylinder 20 and its pertinent drive, and (4) a toothed strip 21 determining the exact interval of each columnal step of the transport carriage 19. In addition, a step shifting latch mechanism 22 is seated on one of the side walls 12, which needs not be explained in detail in this connection, except to say that it is shifted by a plunger magnet 23 in step-by-step movement. At the same time, the mechanism 22 is connected with the transport carriage 19 by way of an elongate flexible connector which may be in the form of a wire, cable or pull rope 25 guided by way of a guide roller 24 to move the carriage counter to the force of a returning spring (not shown). This movement occurs step-by-step, with the type cylinder 20 located in front of the pertinent column to be written on the paper strip 26 covering the platen 14.

As can be seen several similar plunger magnets 33 are seated outside the side walls 12 and 13 on the base plate 11, which can be recognized best from FIGS. 1 and 11. Their function will be explained in the course of the further description. In addition a paper supply roll 27 is inserted between the side walls 12 and 13, as is customary in case of such printing mechanisms.

The transport carriage 19 is suspended from and supported on guide rods 17 and 18 by means of running and guide rolls 28 or 29. The rolls 28, 29 are attached freely rotatably mounted on correspondingly directed strips 30 of a carriage base plate 31 or directly to the latter.

Figure 2:
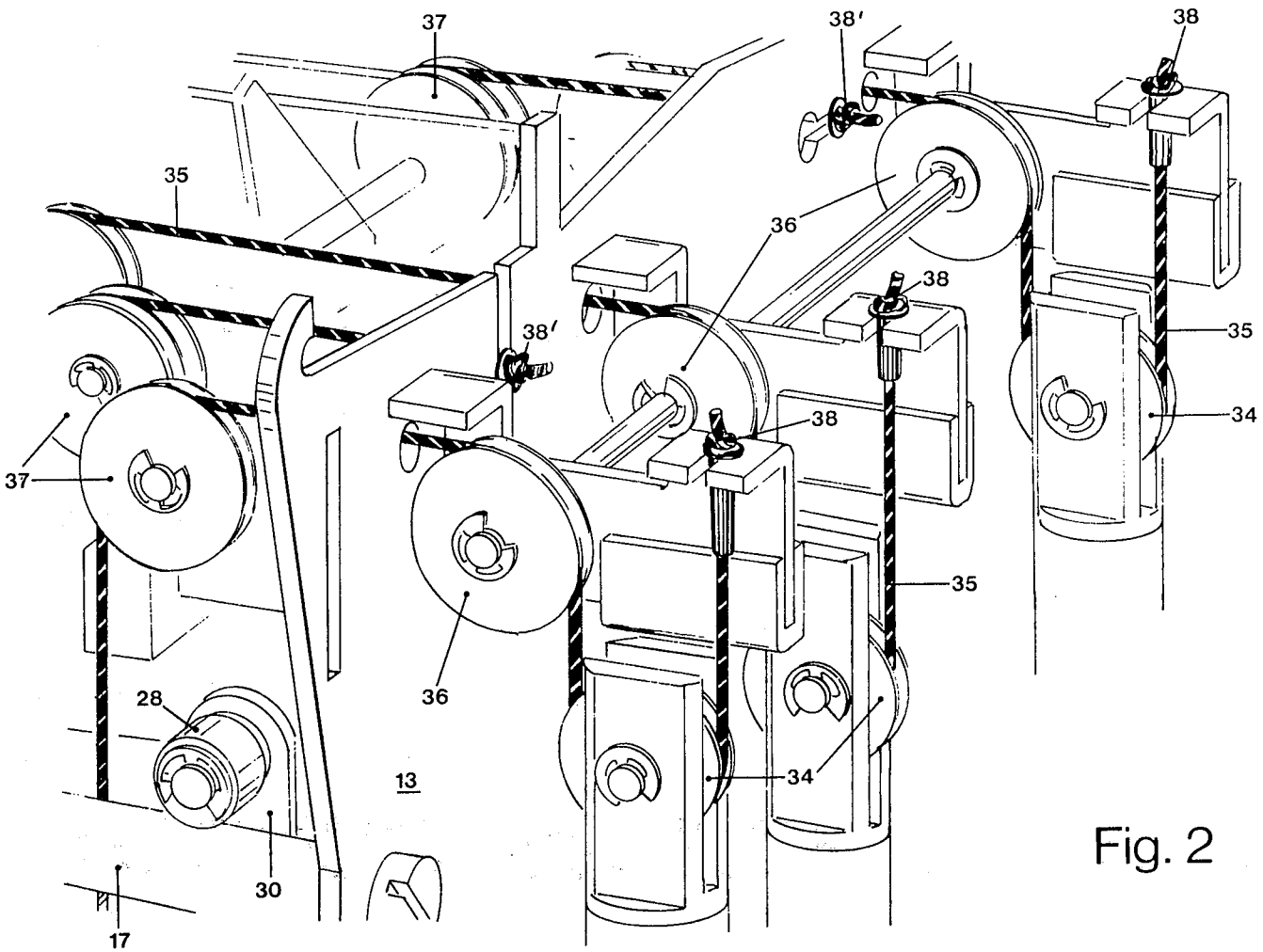
FIG. 2 is an enlargement of a section of the right front corner of the printer as in FIG. 1 in a line of vision turned by 90°.

FIGS. 1 and 2 show, moreover, that plungers 32 of the electromagnetic coils 33 carry freely running rolls 34, around which fixed ropes 35 are guided. The ropes 35 are fixed on points 38 fixed to the frame and are then guided by way of further guide rollers 36 mounted fixedly on the outside of the side walls 12 and 13 of the frame, to additional guide rolls 37 on the type carriage. The ropes 35 are guided from the guide pulleys 37 in the type carriage to rope pulleys on elements vertically movable in the type carriage, and are wound around such movable pulleys. The ropes then run to the opposite side wall to connecting points fixed in the frame, as can clearly be recognized particularly at 38′ in FIG. 2, but also in FIGS. 1 and 11. The vertically movable elements will be discussed later in more detail. As a result of springs on the one hand, which hold the vertically movable elements in the type carriage downwards, and the weight of the plungers 32, as well as the slight pull from the remanent magnetism on the other hand, the ropes 35 are kept sufficiently taut even when the magnetic coils 33 are not energized, so that they cannot jump out from the rope pulleys 34, 36, 37.

A printing hammer 40 is articulated swivellably in the type carriage 19 on the strips 39 of the base plate 31 of the type carriage. The hammer 40 is spring-biased away from the type-head in a ready position and is forced against the type-head 20 by one of the electromagnets 33 by way of one of the pull ropes 35, whenever a stroke is to take place.

The type-head 20, in the form of a cylinder is equipped over its periphery at even intervals with three superposed circular rows of types, each of which rows has eight types. Thus, there are altogether 24 types on the surface area of the type cylinder.

Figure 3:
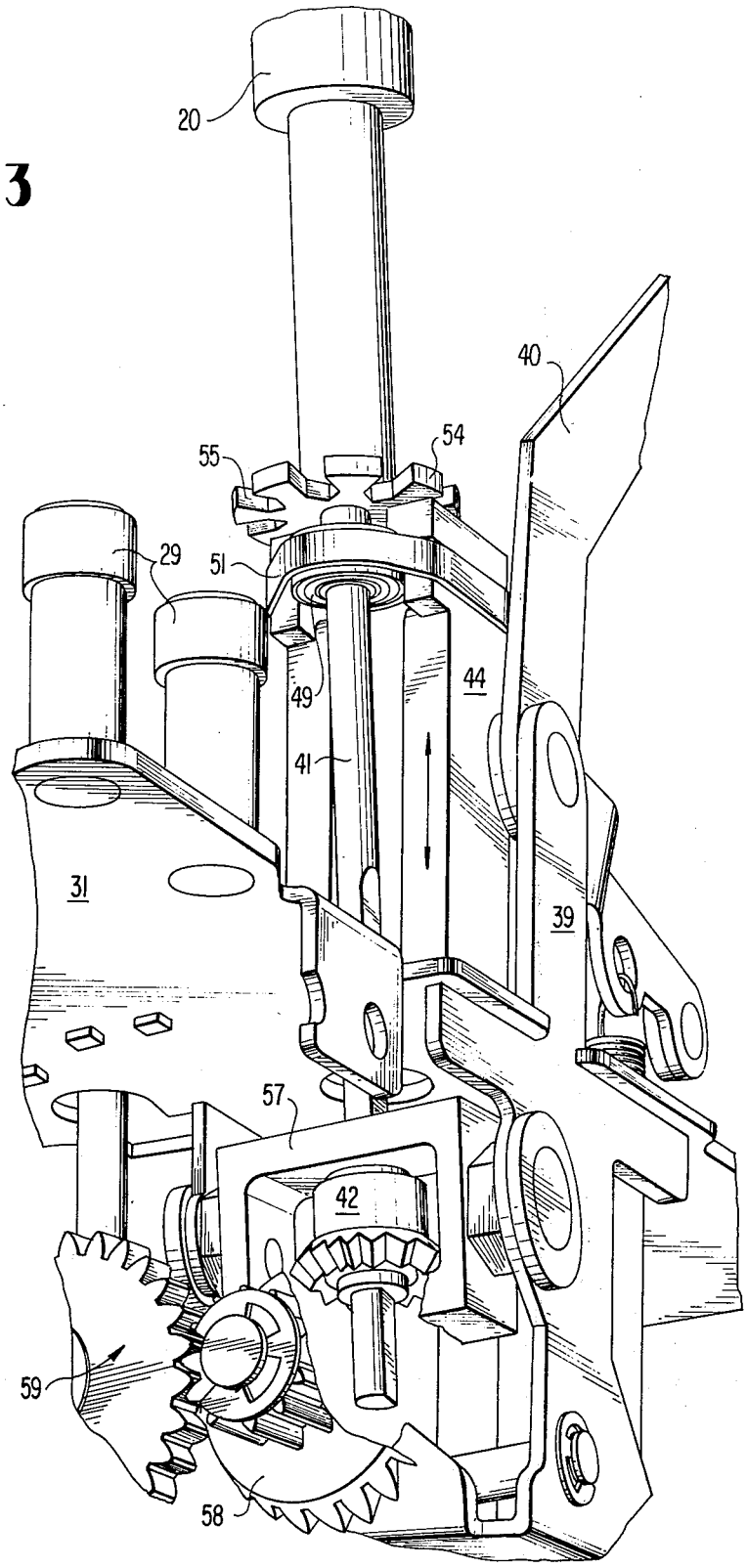
FIG. 3 is a support and guide of type cylinder shaft in the carriage of the printer.

The type cylinder 20 has three possible vertical positions. Insofar as the type cylinder 20 is in its lowered base position, held in it by a spring, the types of the uppermost row are printed each hammer stroke. Beyond that, the type cylinder can be lifted into the middle and then into the topmost position by a pull of individual ropes 35 with the help of two magnets 33 in a manner to be described later on. Moreover, the type cylinder 20 is rotatable around its longitudinal axis by steps, each time by one-eighth of its periphery, by way of its cylinder shaft 41. The shaft 41 is guided vertically slidably but non-rotatably in the hub of a bevel gear 42 of an angle transmission (FIG. 3). A shifting mechanism is provided, which will likewise be described later on, as a result of which all types can be lifted and twisted into the printing position.

Figure 4:
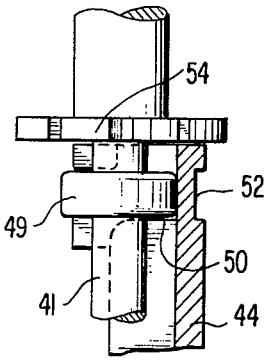
FIG. 4 is a longitudinal section through the area of the type cylinder shaft and its bearing mounting.

The mechanical construction of the lifting mechanism is to be described on the basis of FIG. 9a. A guide rod 43, on which a block 44 can slide as a slide guide, is upstandingly oriented on the base plate 31 of the type carriage 19. This block 44 has been loaded downwards by a spring 45, which is suspended in the frame of the carriage. The block 44 is pivotally connected with a cylinder lifting bridge 46 by means of a cross hinged peg (not shown). This cylinder lifting bridge 46 is vertically shiftable in the type carriage 19 and has a rope pulley 47, 48 at either of its ends, across which runs one each of the ropes 35. A ball bearing 49 is firmly mounted on the type cylinder shaft 41 (see FIGS. 3 and 4) and this ball bearing 49 fits into a recess 50 of the block 44. In addition, an elastic return strap 51 is wound around block 44 and ball bearing 49, which strap may be a rubber band. In order that the return strap 51 cannot shift on said block 44, an indentation 52A has been provided on its reverse side. The ball bearing 49 is pulled by the return strap into the recess 50, and thus together with the type cylinder shaft 41, will be axially unshiftable relative to the block 44. The shaft 41 itself, however, is easily rotatable.

Since the recess 50 is located on the side facing the platen, viewed from the block, the type cylinder shaft 41 can escape counter to the return force of the return band 51, whenever the type cylinder is struck by the hammer 40 during the stroke, so that the type strikes the platen. The return strap 51, however, pulls the bearing 49 immediately afterwards back into the recess 50 of the block 44 again.

The block 44 is held non-rotatably by the two sliding guide rods 43. Now, upon energizing the pertinent magnets 33, the cylinder lifting bridge 46 is lifted by the two ropes 35, as FIGS. 9*b* and 9*c* show.

By energizing only magnet 33 it will be lifted translatably into a diagonal position. As a result, the connecting point, or joint, between the cylinder lifting bridge 46 and the block 44 is raised by half the possible lifting height (FIG. 9*b*).

By energizing both magnets 33, whereby the lifting bridge 46 assumes its horizontal topmost printing position, the connection point is translated into the topmost lifted position. The two ends of the cylinder lifting bridge 46, upon attraction of the magnets 33, are pulled each time against corresponding stops 52, 53, in the type carriage frame, determining the precisely defined upper position.

Figure 7:
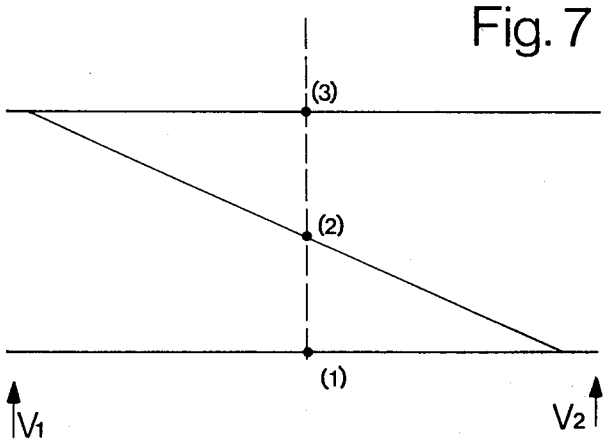
FIG. 7 is a schematic presentation of the switching process for the lifting movement of the type cylinder.

The three possible positions of the point of the joint between block 44 and cylinder lifting bridge 46 are indicated schematically in FIG. 7, whereby the pertinent magnets are designated in the order of their energization by $V_1$ and $V_2$.

Figure 5:
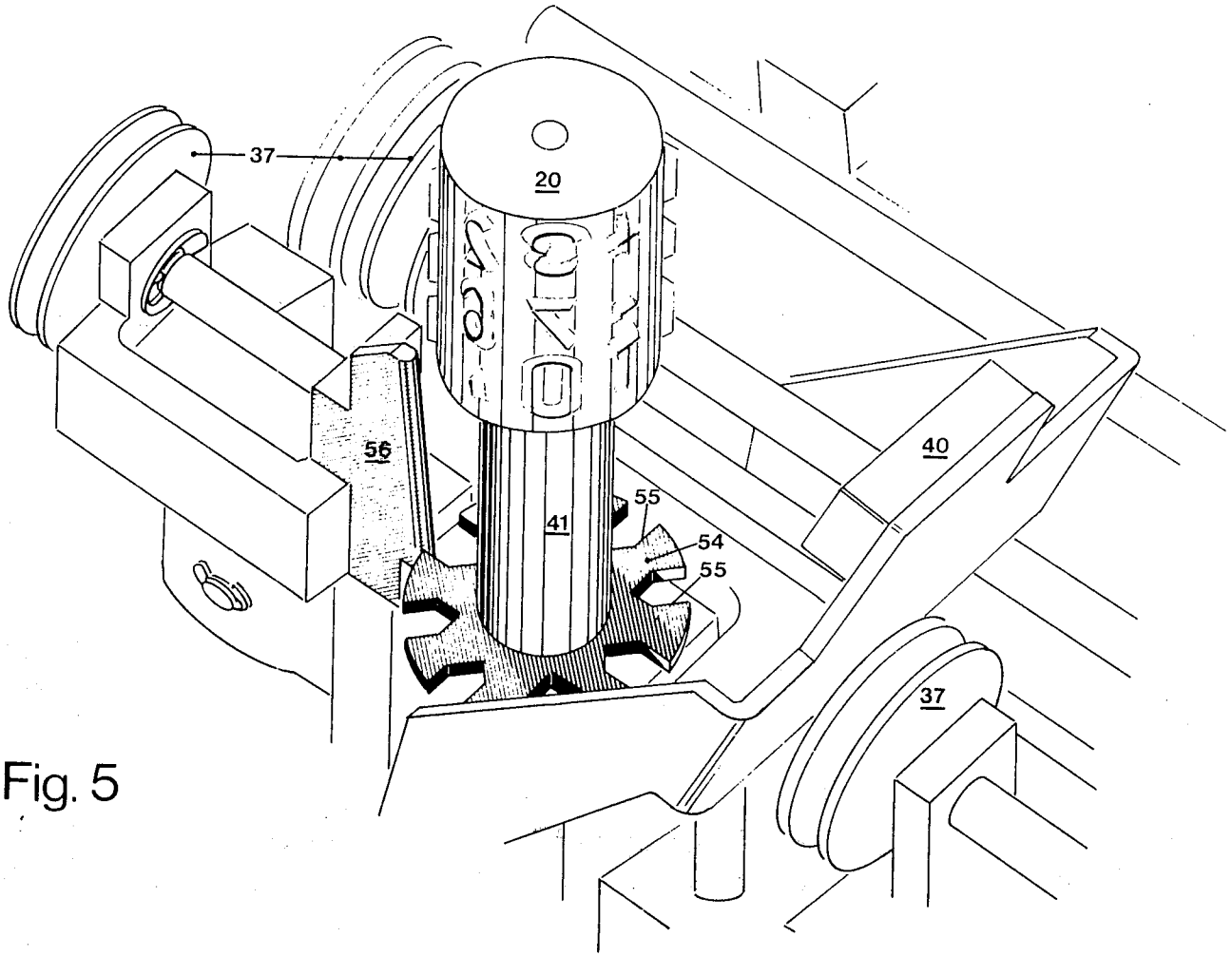
FIG. 5 is an oblique view of the upper end of the type cylinder shaft with type cylinder and guide spline part.

FIGS. 3 and 5 show a ratchet wheel 54 which is mounted firmly on the type cylinder shaft 41. This ratchet wheel has V-shaped notches 55, the number of which correspond to the number of type columns on the type cylinder 20. These notches are aligned exactly with the type columns. Moreover, there is a guide spline part 56 on the frame of the type carriage 19. This spline is located at such a distance from the ratchet wheel that the spline part just misses touching the bottom of the V-shaped notches 55 whenever, upon the stroke, the type strikes the paper of the paper strip 26. As a result of this arrangement, whereby the spline enters the nothces, it will be ensured that the types are aligned exactly without there being any need for a particularly sensitive or slowly reacting angular adjustment of the type cylinder shaft 41. The adjustment of the rotational angle of the type cylinder shaft is thus very easily set.

It is self-evident, that the guide spline part 56 must be inclined obliquely, corresponding to the oblique slant of the type cylinder shaft at the moment of the stroke (FIG. 5), in view of the various positions in height of the ratchet wheel.

Figure 6:
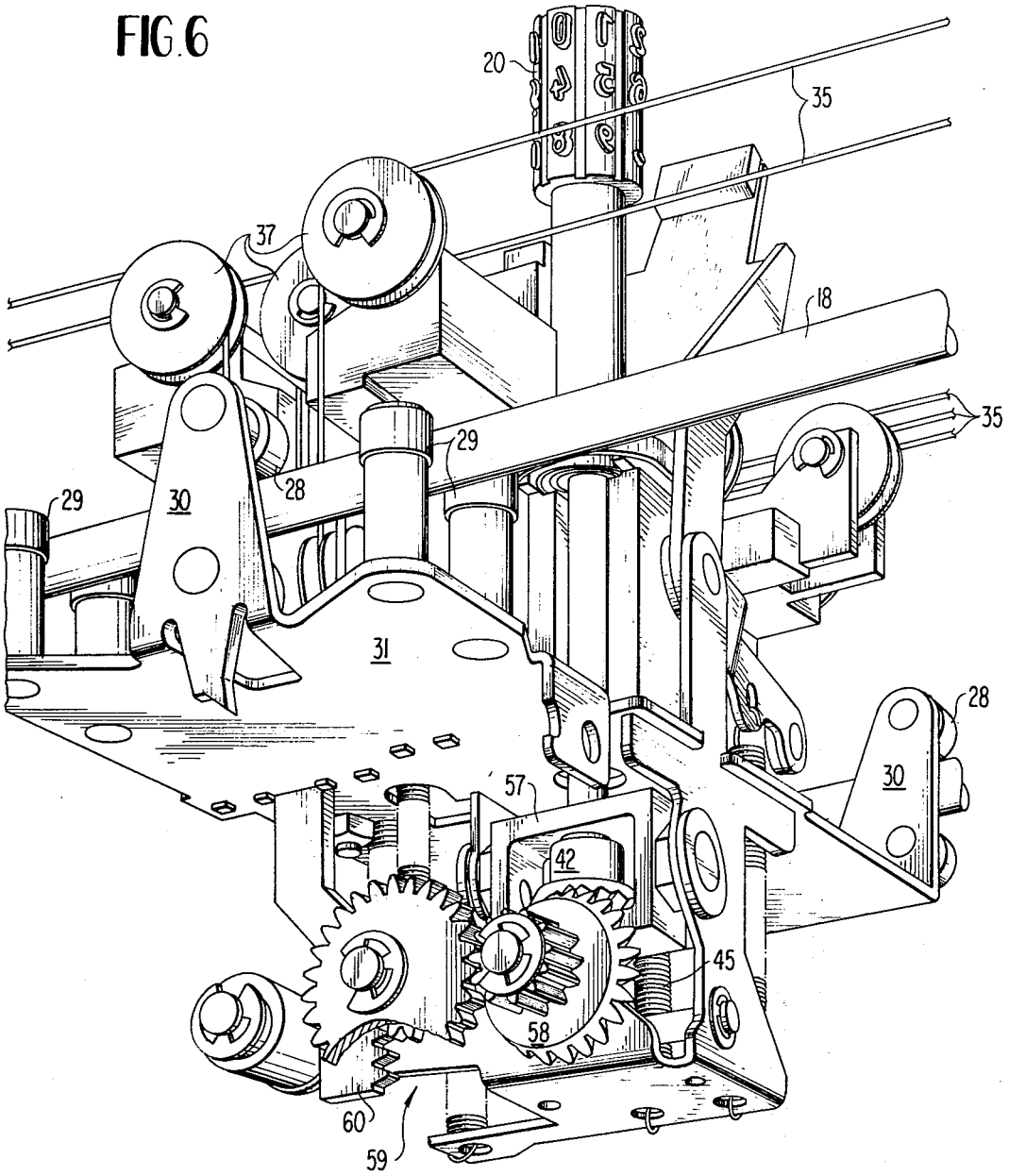
FIG. 6 is an illustration of a gear assembly between the turning bridge of the cylinder and the type cylinder shaft.

The shaft 41 is mounted for sliding movement in an bevel gear 42 of an angle transmission (FIG. 3). In order that the type cylinder shaft 41 can execute a slight swivelling movement whenever the types are to be struck, the outlet conic driver 42 has been mounted in a swivelling frame 57 so as to be swivellable around an axis perpendicular to the type cylinder shaft and perpendicular to the direction of the stroke. However, the swivelling movement is so slight, that the engagement of the conic driver with the opposite bevel gear 58 (see also FIG. 6) of the angle transmission arrangement is not affected. The entire angle transmission arrangement is identified in the FIGURES by 59.

The process of rotating the gear arrangement 59 to achieve the eight different angular positions of the type cylinder 20 with the help of the magnets 33, will best be described on the basis of FIGS. 8 and 10*a* to 10*h*.

First, there is a switching arrangement for altering the type column being printed-out in a given elevational position of the type carriage. In four of the columns of type there are located numbers 0-9; in the other four columns there are located mathematical symbols. Thus, in a first angular position, the cylinder 20 prints numbers. The cylinder can be rotated against a spring bias into three other angular positions to print numbers. From there the cylinder 20 can be rotated to a fifth angular position, located 180 degrees from the first rotational position, wherein symbols can be printed. From there, still against spring bias, the cylinder 20 can be rotated to three more angular symbol-producing positions. In this way, all eight type columns on the type cylinder will confront the platen 14. The individual rotational positions are marked in FIG. 8 by 1 to 4 for the printing of numbers and by 5 to 8 for the printing of symbols.

Figure 8:
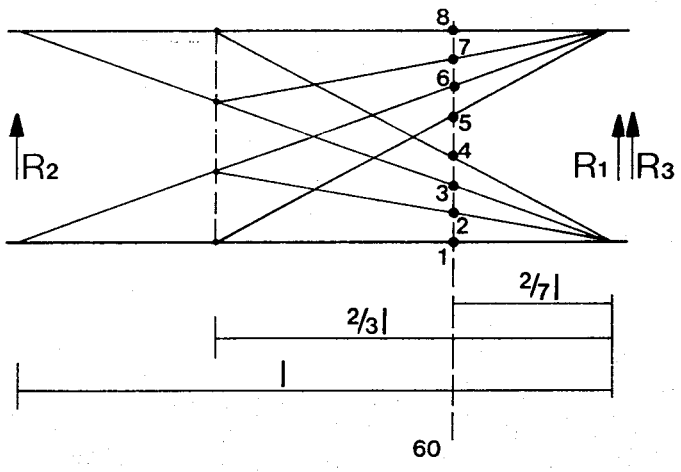
FIG. 8 is a schematic presentation of the switching process for the rotating movement of the type cylinder.

The broken line 60 in FIG. 8 on which points 1 to 8 are marked, corresponds to an input rack 60 (see FIGS. 6 and 10*a*), which is pivotably connected with one point of a base position lever 61. Specifically, the rack 60 is seated on a sliding head 62, which is pivoted to the lever 61, and is guided vertically shiftably on vertical guide rods 63 in the type carriage frame.

A cylinder rotating bridge or swing bridge 64, likewise vertically shiftable, lies parallel to the base position shift lever 61. The bridge 64 carries rope pulleys 65, 66 at each of its ends, by way of which in turn, two pull ropes 35 are guided, and which are connected with two separate magnets 33. In FIG. 8, the adjusting forces of the two magnets 33, through which the movement of rotation of the type cylinder is achieved, are designated by $R_1$ and $R_2$.

At two-thirds distance from the right-hand rope pulley (or one-third distance from the left-hand pulley), the rotary cylinder bridge 64 is pivotably connected by an intermediate block 68, guided vertically on a guide rod 67 in the frame. The block 68 has a further flexible connection with the base position shift lever 61 by way of a hinge pin 69 pointing in the opposite direction, whereby the hinge pin 69 engages with an oblong hole 70 of the base position shift lever 61 for the purpose of a possible adjustment in length. The connecting point between the rotary cylinder bridge 64 and the base position shift lever 61, which point is formed by the axis of the two hinge pins being opposite one another on the intermediate block, thus moves on the broken vertical line in the left half of FIG. 8.

Figure 10A:
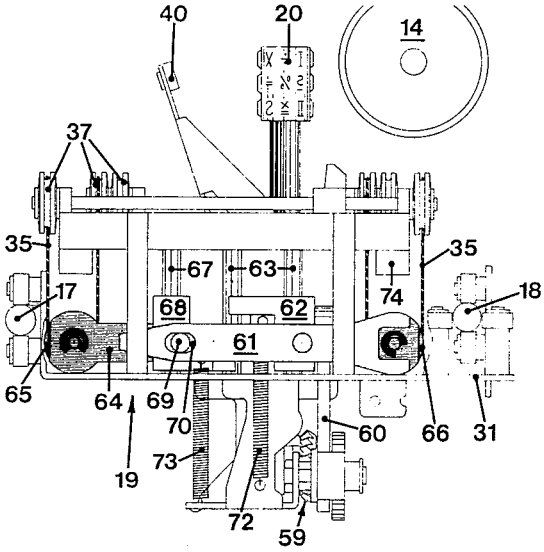
Figure 10B:
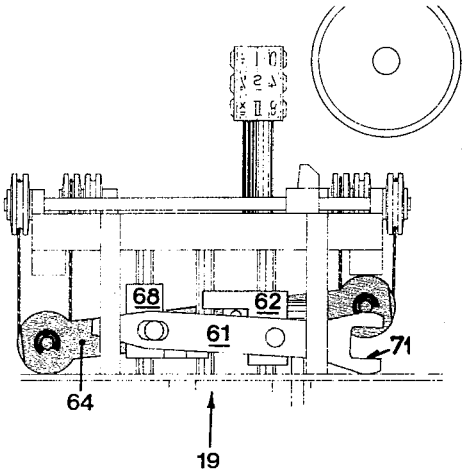
Figure 10C:
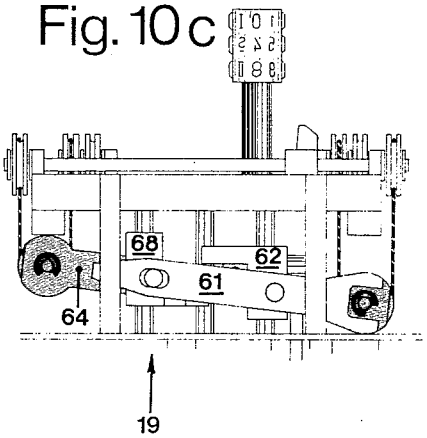
Figure 10D:
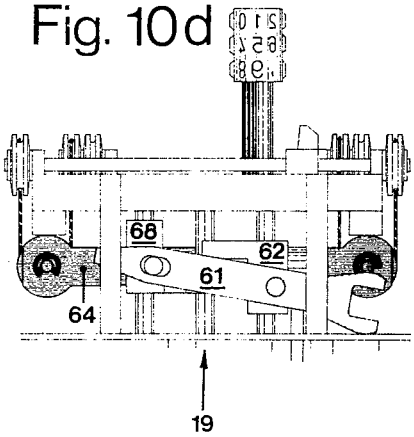
Figure 10E:
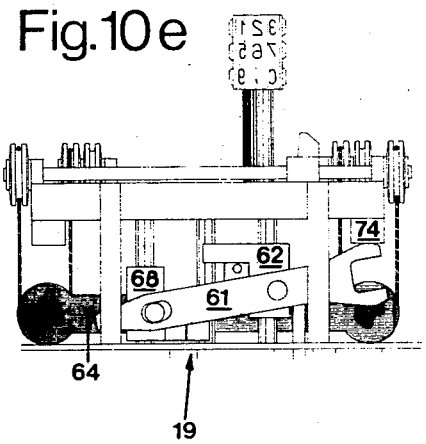
Figure 10F:
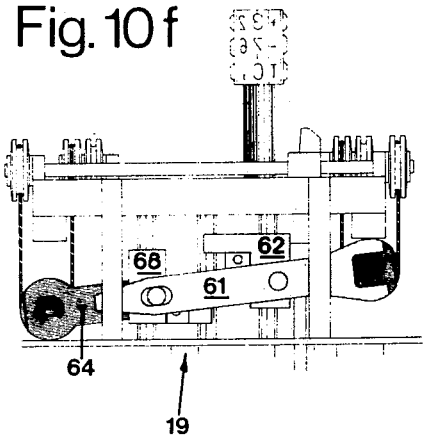
Figure 10G:
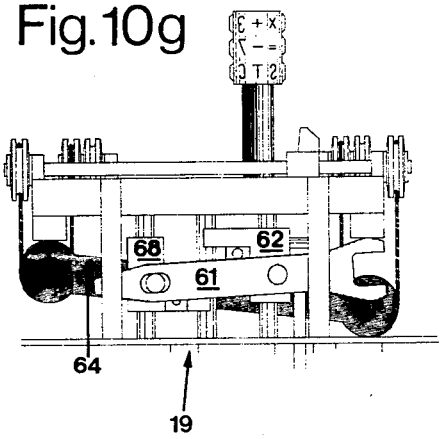
Figure 10H:
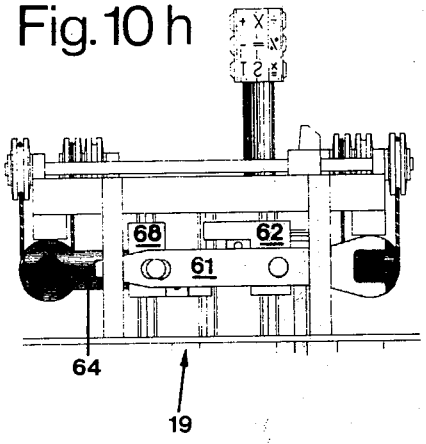

Beyond that, FIG. 10*a* also shows, that the base position shift lever 61 has a recess 71 on its free end. A vertically shiftable lifting pin (not yet shown), controllable by an adjusting magnet, can engage the recess 71 and lift the end of the lever up to a stop counter to the action of (1) a return spring 72 connected with the sliding head 62, and (2) a spring 73 connected with the intermediate block 68. This adjusting force is illustrated in FIG. 8, by the arrow designated by $R_3$.

One can see from FIGS. 10*a* to 10*h*, that by lifting one or both ends of the rotary cylinder bridge 64 by means of ropes 35, guided over the rope pulleys 65 and 66, and by lifting the end of the lever of the base position shift lever 61 above the lifting pin, a vertical shift is always exerted on the sliding head 62. Thus, a vertical shift of the toothed rack 60 is effected because of the pivotable connection by way of the intermediate block 68 and the lever 61. This is accomplished up to a certain lifting step, depending on the effect of the adjusting forces $R_1$ to $R_3$ causing the rotation. These steps 1 to 8 have equal intervals whenever the length of the rotary cylinder bridge 64 and of the base position shift lever 61 on the one hand and the distances between the points for connection of joints on the other hand are selected as shown in FIG. 8. In other words, with the lever 61 in a lower posture, the movement of the bridge 64 creates movement of the rack 60 between positions 1–4 (FIGS. 8 and 10*a-d*). With the lever 61 in a raised posture, movement of the bridge 64 produces adjustment of the rack 60 in positions 5-8 (FIGS. 8 and 10*e-h*).

These equal steps in a vertical direction are then converted by means of the toothed rack 60 and the angle transmission 59 into even steps of rotational angles of the type cylinder shaft 41.

TABLE 1

| Stroke Position | Cylinder Stroke Energization $V_1$ | Energization $V_2$ |
|---|---|---|
| (1) | − | − |
| (2) | + | − |
| (3) | + | + |

TABLE 2

| Number | Binary Control of the Numbers $V_1 + V_2$ | $V_1$ | $R_2$ | $R_1$ |
|---|---|---|---|---|
| 0 | 0 | 0 | 0 | 0 |
| 1 | 0 | 0 | 0 | 1 |
| 2 | 0 | 0 | 1 | 0 |
| 3 | 0 | 0 | 1 | 1 |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| , | 1 | 0 | 1 | 0 |
| C | 1 | 0 | 1 | 1 |

Table 1 shows how the magnets $V_1$ and $V_2$ for the cylinder stroke must be energized in order to achieve the individual stroke positions 1 to 3 of the type cylinder. Table 2 shows how the magnets $V_1$ and $V_2$ and the magnets $R_2$ and $R_1$, causing the rotation of the type cylinder shaft, must be energized in order to bring about the stroke of the number indicia, in the case of an arrangement of the numbers on the type cylinder as seen in the FIGURES, especially FIGS. 10*a* to 10*d* (i.e., twelve of the twenty-four possible positions). At the same time, it becomes quite clear from Table 2 that the outlet binary signals normally applied to an electronic calculator (e.g. a table model calculator) can be used directly, possibly with the aid of an amplifier, in order to accomplish the corresponding control of the printer of the present invention. Therefore, for the twelve positions mentioned in Table 2 are used the three variable positions of height according to FIG. 7 on one hand, and four different angular positions 1 to 4 of FIG. 8 on the other hand.

By additionally switching-on of the power $R_3$, i.e., by lifting of the base position shift lever 61 by means of the lifting pin, it will then be possible to select the remaining twelve symbol-indicia positions (FIGS. 10*e*–10*h*) located on the second half of the surface area of the type cylinder, with otherwise the same control as in Table 2.

FIGS. 10*a* to 10*h* all show eight possible angular positions, including the case wherein the base position shift lever 61 is raised against an upper stop (FIGS. 10*e*–10*h*). Thus, all 24 type positions of the type cylinder 20 can be selected with (1) the three possible stroke positions according to FIGS. 9*a* to 9*c* and (2) the eight possible angular positions of FIGS. 10*a*–10*h*.

Now let us still describe a possible control of the base position shift lever 61 with the help of a lifting pin. Customarily, there is a blank step between the symbol printing positions on the right edge of the paper strip and the printing positions for the numbers following to the left. There is a lifting pin on the base frame, lowerable vertically against the action of a spring, as will be subsequently discussed in detail relating to pin 143 (FIGS. 18–20). This lifting pin is connected with the conveying arrangement for the paper feed in such a way that it is held lowered during the return of the type carriage into the right hand terminal position. In such position it engages with the notch 71 of the laterally approaching base position shift lever 61. If then the magnetic force acting on the lifting pin in the right terminal position ceases, as during selection of a symbol to be typed, then the pin is pulled up and thus lifts the base position shift lever toward its upper stop 74. According to FIG. 8, $R_3$ then becomes effective and only the rotary angle positions 5 to 8 can be occupied whenever the forces $R_1$ and $R_2$ are turned on by energization of the corresponding magnets for the stroke.

However, the lifting pin is dimensioned such in its length, that it will slip out of the recess 71 of the base position shift lever 61 when the carriage 19 shifts out of the right hand position and into the area of the blank step. Consequently, the base position shift lever, with its free end, is pulled downward under the effect of the spring 72 and assumes one of the positions according to FIGS. 10*a* to 10*d* corresponding to the effect of the rotational forces $R_1$ and $R_2$. In other words, the type cylinder 20 can now be turned, i.e., rotated into the print positions for numbers.

If there is no intention to effectuate base switching positions with the help of such a lifting pin connected with the paper feed, there may be provided a special base position switching magnet provided for a similar purpose. That is, the magnet would move the lifting pin up or down, possibly by way of a lever, in order to move the free lever end thereof into the upper stroke position for printing of symbols according to requirement of the rotational force $R_3$.

FIG. 11 shows the base frame of the serial printer separated into two parts, namely into an upper part carried between the side walls 12 and 13, which upper part contains all moving parts of the printer, and a lower part which consists essentially of the base plate 11. The plate 11 is made of soft iron and carries the magnet coils 23 and 33. The upper part can be released very simply from the soft iron plate 11 by means of a few screws.

This design has the special advantage that the part of the serial printer provided with electric connections, namely the magnet coils 23, 33, can be produced in an operation entirely separate from the mechanical part. These two parts need be assembled only at the last moment.

It is clear furthermore from FIG. 11, however, that the electromagnetically effective part, namely the base plate 11 with the magnet coils 23 and 33, can be produced very simply. This is accomplished by punching separating slits into the soft iron plate. The individual metal yoke sheets 75 developed as a result of that need only be bent up as yoke sheets in order to form a part of the magnetic return connection path for the magnet coils 23 and 33. The yoke sheets 75 extend in an axial direction laterally on the magnet coils 23, 33 and, after the coils have been inserted between them, are connected with one another by means of cover sheets 76 to completely close the magnetic closing circuit. The cover sheets have been provided with bores 77, concentric to the magnet coils, for receiving the magnet armature 32.

In the present case a positive connection is established by punched-in slit 78 in yoke sheets 75 above the front edge of the coil, standing at one side of the coils 23 and 33. In each such slit a peg projection 79, formed on the cover sheet 76, is inserted. On the other hand, the cover sheet likewise has an equal slit 80 corresponding to peg 81 of the opposite lateral yoke sheets, and the pegs 81 are tamped therein after the cover sheets have been put on.

The FIG. 11 also shows that the magnet coils 33 for all operating processes in the type carriage are similar so that this also represents a simplification in fabrication.

FIG. 12 shows, in a time diagram, the course of the pulses and movements which are imparted to the printer or which are executed by it whenever it is set for an operating frequency of 20 strokes per second. One can recognize that the control by means of the pulses for the type selection and the step-by-step movement are interrelated in that the stroke of the hammer must only occur whenever no movement of the type carriage or the type-head takes place for selecting the type. The first interval I (0 to 50 milliseconds) shows the movement of the type-head occurring under the effect of the magnet coils during which a certain printing type is moved into printing position. Step-by-step movement takes place counter to the action of return springs but is accomplished after a maximum interval of essentially 25 ms from the beginning of the impulse. After another 5 ms the voltage supply to the magnet coils is lowered to a residual holding value, which suffices for holding the magnet armatures 32 in their state of having been pulled into the coils 33. This residual value amounts to about one-third of the value of the pulse of the operating current. Thus, the heating of the magnet coils is limited and consequently they can be made smaller.

All intervals for type selection correspond to interval I, since every new selection movement always starts out from the previous one, not from a common rest position as in the case of known printing mechanisms. In such prior art mechanisms the type-head must first drop back each time, a time-consuming procedure. As a result of the present invention, therefore, considerable time is saved and the return springs, against which the magnets must operate, need to be less powerful. This means a saving of magnetic power and thus of applied energy. The resulting forces are of less intensity, thereby imposing less wear and less noise.

If two equal types are printed successively, then the voltage applied to the selection coils in the interval following the first one remains at the same value (in interval II shown in broken lines in FIG. 12), and the type-head remains in the position set. Step and stroke of the hammer take place in the manner already described.

In the interval II (0 to 100 ms) the process is illustrated in solid lines, taking as an example selection of the number 0 for printing. To move the printing type 0 into stroke position, no voltage is applied at the type selecting coils $V_1$, $V_2$, $R_1$, $R_2$, i.e. these coils are not energized. The rotary cylinder bridge 64 and the lifting cylinder bridge 46 are pulled by their return springs into their lowest positions. The impulses for the type selection are therefore 0, and the type-head, under the effect of the return springs, reaches the zero position from its previous position within 44 ms and is hammered by the hammer no less than 2 ms later against the paper. In any case, care has been taken that the position of the type desired for printing has been occupied before the printing hammer hammers the type-head against the printing paper 26 on the platen 14, without waiting so long as to unduly reduce the printing speed.

Since the individual positions of the auxiliary elements such as rotary cylinder bridge, cylinder lifting bridge and base position shift lever are always stop or terminal positions into which they are pulled by way of the control ropes 35, no excessively high precision of parts is required which would necessitate more expensive parts. Moreover, the type cylinder has a certain play and thus permits tolerances in the adjustment, which tolerances, during the stroke, are compensated by the ratchet wheel 55 and the guide spline part. Thus, no excessively high precision is needed here either. Moreover, plastic parts can be used in many cases, which make the production not only cheaper, but which also lower the weight of the serial printer considerably, decrease the formation of noise, and make the apparatus largely maintenance and wear free. The sheet metal parts are generally very simple stamped parts with relatively few shoulders and bends, so that from this point of view too, the printer can be produced with relatively low expenditure.

FIGS. 13 and 17 show a side wall 12 of the printer's frame from which project rigidly and laterally an axle 101 of a rope drum 104. Extending parallel thereto at a distance is a stationary axle 102 for a ratchet 103. On the axle 101 the rope drum 104 is seated freely rotatably, around which drum a pull rope 25 is wound. This pull rope 25 is guided over reversing rolls to the type conveying carriage 19. A ratchet wheel 105 with teeth on its periphery is coaxially firmly connected with the rope drum 104, with which the already mentioned ratchet 103 and a feed ratchet 106 engage. The ratchet 103 is forced in the direction of the ratchet wheel 105 by a spiral spring 107 that is braced against the frame. On the axle 101 of the rope drum a plate carrying a toggle lever 108 (FIG. 14) is also seated freely rotatably. The lever 108 is connected to a control rod 127 which is biased by a spring 112. The lever 108 carries an axle 109 at one of its lever ends. To the axle 109 is pivotally connected a control rod 110 which is also pivotally connected to the magnet armature 23. Furthermore, the feed ratchet 106 is rotatably mounted on the axle 109 between the arm of the lever 108 and the connecting control rod 110. The ratchet 106 is spring loaded by means of a spiral spring 111 toward the ratchet wheel 105.

Upon attraction of the armature of the magnet 23, the toggle lever 108 is swivelled on the axle 101 of the rope drum. As a result, the feed ratchet 106 advances the ratchet wheel 105, together with the rope drum 104, by a tooth pitch. At the same time, the ratchet 103 slides over a tooth and drops, under the bias of the spiral spring 107, into the next tooth gap. Thus, upon de-energization of the magnet 23, the toggle lever 108 will swing upward under the bias of the spring 112. The feed ratchet 106 now drops into the next tooth gap after also slipping over a tooth. In this manner the draw rope 25 will have been wound by a length corresponding to the column step onto the rope drum 104. Thus the carriage will have been shifted by one incremental step.

The plate carrying the lever 108 also carries a second lever arm 113 which is directed essentially perpendicularly downward from the shaft 101 of the rope drum. The lever 113 carries a laterally projecting peg 114. Also, the lever arm 113 lies at a certain distance from the lateral wall 12 of the frame in parallel relation thereto. In the space between the lever arm 113 and the lateral wall 12 a cylinder ring 115 is inserted, with the inside space of which the peg 114 engages. The ring 115 moreover is guided vertically between two limiting strips 116, 117, the distance between these being equal to the outside diameter of the cylinder ring. A tension spring 118 engages a constricted place 119 of the ring, which place is located in the lower part of the ring curve transversed by the lever arm 113. This spring braces the ring 115 against the printer frame.

The previously described arrangement serves for braking the toggle lever 108 with a force rising continuously, according to a tangential function, towards the ends of its path of movement and in addition to ease the use of the starting acceleration. During return of the lever 108 to a rest position by the spring 127, rotation of the ring 115 lengthens the spring 118 and increases its resistance to brake the lever 108. Downward movement of the lever 108 by the magnet 23 is aided by the spring 118. As a result of that, both noise and impacts are dampened considerably. FIG. 14 clearly shows the basic design of the arrangement just described.

On its side facing the side wall of the frame the ratchet wheel 105 has been provided with a coaxial extension 119 (FIG. 15). This extension defines a spiral crank path. A schematic presentation is shown in FIG. 15, which shows the ratchet wheel 105 with the extension 119, from the opposite side as compared to the showing of FIG. 13.

The crank path is formed by a considerable peripheral section of the extension 119 as well as by a channel 120, lying helically along the outside section of the path. A lever 122 is pivotally mounted on the fixed axle 102 and carries a crank peg 121 at its free end. The channel 120 is open at one end toward the periphery of the extension 119, so that the crank peg 121, upon rotation of the ratchet wheel 105, can slide in and out of the crank channel smoothly. There is a stop attachment 123 on the periphery of the extension 119, forming one end of the crank path, over which the crank pin 121 cannot slide. The opposite end of the crank path is formed by the inside end of the crank channel 120.

The crank pin-crank path arrangement relative to the pull rope 25-rope drum 104 arrangement is such that the crank pin 121 still maintains a small distance from the stop attachment 123 whenever the type carriage in the frame has run into its right hand stop (stroke) position. On the other hand, the crank peg 121 touches the inner end of the crank channel 120 before the type carriage has been pulled by way of the ratchet arrangement 105-127 against a left hand frame stop during step-by-step shifting. With this, one will achieve the result that the pull rope 25 cannot be exposed in any case to forces which are greater than the force of the spring which pulls back the type carriage augmented by the acceleration force of the type carriage.

In order that the lever 122 cannot be flung up during the very rapid return rotation of the ratchet wheel in the transition step from the crank channel 120 to the peripheral section of the crank path, a tab 125 (see FIG. 13) is bent from the side wall 12 of the frame at a little distance over the lever 122.

The previously mentioned guide rod 127, connected with a third lever arm 126, serves for the rythmical drive of the toothed strip 21. FIG. 16 shows a clear illustration. The rack or toothed strip 21, disposed parallel to the path of movement of the type carriage 19, constitutes one edge of a subframe, designated altogether by numeral 128. This subframe is mounted with attaching clips 129 in windows 130 of the side walls, of which only the wall 12 has been drawn. This mounting is of a swivelable nature such that the toothed strip 121 can be displaced upward. The rod 127 is operably connected to the rack 21 such that activation of the magnet 23 produces upward movement of the rack 21. A stop tooth 131 is fixed on the type carriage 19. In case of a lowered rack 21, the tooth 131 is located above the rack 21 at a certain distance. However the tooth 131 engages with the teething of rack 21 whenever the rack is lifted. The tooth pitch is equal to the incremental or columnal step of the type carriage 19.

In case of any switching step effected by the magnet 23, the type carriage 19 is accelerated by the rope 25 from right to left and the rack 21 is lifted upwardly. The arrangement is such that the carriage 19 together with the stop tooth 131, covers part of its incremental step before the rack 21 is lifted far enough for the tooth 131 to mesh with the rack. Therefore, the carriage will be stopped only at the end of the step and, as a result, it will be prevented from swinging out beyond the precise printing position of the column despite the great acceleration force during switching. Thus, the carriage assumes the required rest position for printing of the type adjusted on the type-head, which printing follows immediately afterwards.

Especially FIG. 17 and also FIG. 13 show an additional switching mechanism, which is operated by a magnet 33*a* and which carries out the following four functions:

a. Triggering of the ratchet arrangement on the rope drum 104 for the return of the carriage at the end of each printed line;

b. Paper advance by one line;

c. Advance of the colored ribbon;

d. Making the reversing mechanism available in order to transfer the cylinder rotating bridge from the base position for numbers into the base position for symbols at the end of the return of the carriage.

The switching mechanism referred to above has a multi-armed lever 133, which is rigidly connected with a control shaft 132 passing transversely through the printer frame. The lever 133 carries first and second arms 134 and 135. The outside, essentially horizontal first lever arm 134 is pivoted to the armature of the electromagnet 33*a*. The second lever arm 135 located opposite to the first lever arm 134, projects from the multi-armed lever 133. The arm 133, at its end has the shape of a fork which receives a peg 136, the latter being seated on a cam plate 137. The cam plate 137 is attached rotatably on the axle 101 of the lateral drum 104.

On the side of the cam plate 137, facing the ratchet wheel 105, there are arranged disengaging cams 138, 139 (see also FIG. 13). These cams can engage with the ratchet 103 and the feed ratchet 106 whenever the cam plate 137 is swivelled by way of lever arm 135, in response to actuation of the magnet 33*a*. The ratchets 103, 106 are lifted out of the teething of the ratchet wheel 105 as a result. The type carriage, pulled by its return spring, can pull off the pull rope 25 from the rope drum 104, and can return into its right hand starting position. The magnet 33*a* is then de-energized whenever the type carriage 19 has travelled entirely to the right, which will be explained in more detail later on. The disengagement cams 138, 139 will then release the ratchets so that they can drop into the teething of the ratchet wheel 105.

Next, a further function of the switching mechanism, actuated by the magnet 33*a*, will be described in FIGS. 18 to 20. FIGS. 19 and 20 show, by way of a broken opening in the side wall 13 of the frame, a part of the type carriage, whereby the switching lever 61 in its base and lifted positions has been emphasized particularly clearly. This lever 61 has its end developed like fork 71 as previously discussed. In a lowered position of the lever, numbers are printed. In this position, the lever 61 is held by a spring 72 in the carriage 19. The forked end of the switch lever 61 for the base position must be lifted into the highest possible position for the printing of symbols rather than numbers.

In the rest position, i.e., wherein the magnet 33*a* is not energized, shown in FIGS. 13 and 17, a pivot lever 140 on the side wall 13 of the frame is swivelled by a spring 142 into a lifted position. The lever 140 is pivotally mounted on an axle 141 fixed to the frame. In the lifted position of the lever 140, a lifting peg 143 seated on the free end thereof, passes through a window 144 in the side wall 13. On the top side of the pivot lever 140 rests the free end of a bent lever 146 with a laterally projecting roller 145, which lever is connected firmly rotatably with the shaft 132. Let us state moreover, that the entire mechanism is held by the spring 142 in the position shown in FIGS. 13 and 17, as long as the magnet 33*a* is not energized.

Whenever the magnet 33*a* is now energized for returning of the carriage, the bent lever 146 swivels the pivot lever 140 into the position shown in FIG. 20, in which the lifting peg 143 assumes the lowest position. The swivelling movement is indicated by arrow 147. The type carriage 19 at the same time travels in the direction of the arrow 148 toward its right hand end position, whereby the switch lever 61 for the base position is in the base position for printing numbers, i.e., it is with the fork 71 in the lowest possible position. Therefore, the opening of the fork and the lifting peg 143 are aligned, and the type carriage 19, starting on the right, guides the opening of the fork over the lifting pins 143.

In this right hand end position, the magnet 33*a* is de-energized and now the strong spring 142 can move the lifting pin at the end of the pivot pin 140 into its highest position, counter to the spring 72 in the type carriage 19. This pulls the switch lever 61 for the base position up, as a result of which the rotary bridge for the cylinder (not shown) in the type carriage 19 is pushed into the printing position for symbols. The entire multi-armed lever 133 then again resumes the position shown in the FIGS. 13 and 17.

Thus, at the beginning of the next line only the printing type elements which comprise symbols are selected from out of the base position for printing symbols until the fork 71 slides away from the lifting peg 143. In the moment of transition from symbols columns to numbers columns, the fork will slip off the lifting peg 143 and drop into the lowest position, so that then only numbers will be printed.

The multi-armed lever 133 is equipped with an additional lever arm 149 pointing essentially vertically upwards, on the free end of which arm 149 an axle 150 projects obliquely (FIG. 13). On this axle 150 there is a rotatable ratchet 152, loaded by a spring 151, which engages with the teething of a ratchet wheel 153. The wheel 153 is connected with the platen 14 so as to rotate the latter. When the magnet 33*a* is energized, the lever arm 149 swivels in a direction toward the ratchet wheel 153. Thus, the ratchet 152 rotates the platen forward by one line. If the magnet is then switched off, then the ratchet 152 moves into the next notch and is ready for the next switch of the line. The customary jump arresting holder with spring loaded roller and gear are on the same shaft as the platen, and are not necessary to describe in detail.

Finally, an inking, colored ribbon is also advanced a certain stretch by the multi-armed lever 133 at every switching process. This is accomplished by means of a push plate 154, which is mounted rotatably on the axle 150 of the third lever arm 149. The plate 154 is guided essentially horizontally by means of a slot at its other end, which slot receives a peg 155 fixed on the frame (FIGS. 13, 17). The push plate 154 projects (extends) under a colored ribbon box 159, yet to be described later on, and carries on its upperside a ratchet tooth 157 on a leaf spring 156. The tooth enters the box from below through a window 158 in the bottom of the box 159. The tooth engages the teething of a felted inking drum 160 for the colored ribbon 161. At each swivel of the third lever arm 149 as a result of the energization of the magnet 33*a*, the ratchet tooth 157, engaging with the teething of the felted inking drum 160, pushes this drum 160 forward by a stretch. Subsequently the tooth 157 slides over the teething during the back swivel of the multi-armed lever 133, while the felted inking drum 160 is held by friction. The spring 156 can consist of plastic and can be formed directly to the push plate 154. The spring action and elasticity resulting therefrom is sufficient entirely for the required forces.

The inking colored ribbon box 159, seated removably on the printer frame, is formed essentially by two approximately equal limiting plates, which are kept at a distance by pegs. The short colored ribbon 161 is placed around the felted inking drum 160, mounted rotatably between the plates, and also around a deflecting pin in the inside of the box and two deflecting pins 162, 163. The ribbon 161 is kept taut by a spring-loaded tightening roll, not shown, so that a section of the colored ribbon 161 will run directly in front of the paper strip 26, lying on the platen, on the level of the line to be printed. Hooks 164, 165 on the frame reach through apertures in the lower plate of the box and hold the latter in the desired position.

The tear-off track 166, lying in front of the paper strip 26, is connected between the side walls 167, 168 of the paper guide unit, and as FIGS. 17 and 22 show, it runs above the stretched colored ribbon 161 across the width of the paper strip 26. The side walls 167, 168 are swivelably mounted on the shaft 169 of the platen 14. In order to insert a new web of paper, the side walls are rotated forwardly in such a way that the paper input side, or the lower edge, of the tear-off track 166 is disposed at a short distance from the platen 14 and stands directly above an exit gap formed between the platen 14 and mounting roller 16 for the paper, the roller being located in front of the platen 14. The side walls 167, 168 at the same time, have a horn-like extension 170 at the lower end, which during this forward swivelling reach an elastic contact position against a rod 171. This rod keeps the side walls 12, 13 of the frame at a distance. The extension 170 can be stopped by means of a stop notch on said rod that can hardly be discerned in the drawing.

The side walls 167, 168 can be arranged to cam the pressure rolls 16 away from the platen whenever a new strip of paper is to be threaded into the machine, as will be apparent from FIG. 22.

The paper strip 26 advancing in the direction of the arrows 172, 173 indicated in the FIGS. 21 and 22, during introduction of the paper strip, is threaded in thus automatically below the tear-off track 166. The entire paper guide unit is then swivelled into the normal operating position where clamp attachments 174, 175 at the two side walls 167, 168 overlap the rod 171 and stop the paper guide positively.

It is desirable that the colored ribbon 161, which during printing is to run at the smallest possible distance in front of the paper strip 26, does not soil the tear-off track 166 in the forward swivelled state of the paper guide. Accordingly, the side walls 167, 168 are provided with cam edges 176, 177, projecting in front of the tear-off track. These edges force back the color ribbon 161 in the area between the deflecting pegs 162, 163, while the box 159 for the color ribbons is put on.

SUMMARY OF MAJOR ADVANTAGES

As a result of the present invention, wherein electromagnets drive the printer parts, the printer needs no driving motor and thus no clutches and other constantly rotating parts and it therefore needs largely no maintenance. The individual magnets are cheap, can easily be triggered and offer sufficiently large adjusting forces, making quick movement possible. The transfer of the forces, emanating from the armatures of the magnets by means of ropes and reversing rollers is particularly simple and likewise requires no maintenance. The printer makes little noise and, during the pauses in printing, is completely noiseless. For starting, it requires no previous switching on, or even clutches, so that it is only necessary to utilize the output binary signals of a table calculator and feed them to the printer. The number of individual parts required for such a printer, can be lowered in that case to less than 150, whereby naturally the number of the digits that are to be printed by a serial printer may be of any given size. Finally, there is no cause to start out from a basic position in case of every new triggering of the next value. The triggering takes place each time directly from the previously triggered value, which means a saving in time and thus a quicker printing sequence, because of omission of the time needed for the return into the basic position.

Although the invention has been described in connection with a preferred embodiment thereof, it will be appreciated by those skilled in the art that additions, modifications, substitutions and deletions not specifically described may be made without departing from the spirit and scope of the invention as claimed in the appended claims.

What is claimed is:

1. A serial printer suitable for operable connection to an electronic calculator and the like, said printer comprising:

a frame means;
a platen mounted on said frame means;
a carriage on said frame means being movable in step-by-step fashion adjacent said platen in parallel relation to the axis of said platen;
a type-head for carrying type indicia, said type-head being mounted on said carriage for translational and rotational type-shifting movements and for printing movement toward said platen;
type-head shifter means for impelling said type-head toward said platen; and
printer actuating means comprising:
first electromagnet means mounted on said frame means;
first cable means operably connected to said first electromagnet means for being displaced by operation of said first electromagnet means;
type-head translating means for translating said type-head independently of minor variations in length of said first cable means including:
first shiftable means mounted on and carried by said carriage in driving connection with said type-head, said first shiftable means being connected to said first cable means to be shifted to a plurality of translation adjustment positions in response to selective operation of said first electromagnet means for translating said type-head in a manner changing the type indicia disposed in printing position,
first stop means mounted on said carriage and being engageable with said first shiftable means to:
define said translation adjustment positions,
locate said first shiftable means in said translation adjustment positions, and
prevent overtravel of said first shiftable means beyond said translation adjustment positions;
second electromagnet means mounted on said frame means;
second cable means operably connected to said second electromagnet means for being displaced by operation of said second electromagnet means; and
type-head rotating means for rotating said type-head independently of minor variations in length of said second cable means including:
second shiftable means mounted on and carried by said carriage in driving connection with said type-head, said second shiftable means being connected to said second cable means to be shifted to a plurality of rotary adjustment positions in response to selective operation of said second electromagnet means for rotating said type-head in a manner changing the type indicia disposed in printing position, and
second stop means mounted on said carriage and being engageable with said shiftable means to:
define said rotary adjustment positions,
locate said second shiftable means in said rotary adjustment positions, and
prevent overtravel of said second shiftable means beyond said translation adjustment positions.

2. A printer according to claim 1 wherein said type-head comprises a cylinder; said cylinder being rotatable about a generally vertical axis, to eight equi-distant angular type-orienting positions, and is vertically translatable to three vertical type-orienting positions.

3. A printer according to claim 2 wherein said type cylinder includes a generally vertical, rotatable shaft; said shiftable means of said type-head translating means including a cylinder lifting bridge, said rotatable shaft being carried at the center of said cylinder lifting bridge; said first cable comprising a pair of first cables; said first electromagnet means comprising a pair of first electromagnets; said lifting bridge carrying a pulley at each end for reception of respective ones of said first cables such that respective ones of said first electromagnets are connected to said first cables to lift said bridge ends singularly or together so as to translatably shift said type cylinder; and spring means for biasing said bridge downwardly toward resting engagement with a stationary frame plate on said carriage.

4. A printer according to claim 3 wherein said bridge is arranged to locate said type cylinder in:
a first of said vertical type-orienting positions when both bridge ends are in a lowered position,
a second of said vertical type-orienting positions when one of said bridge ends has been raised by one of said first electromagnets that are operably connected to the bridge ends, and
a third of said vertical type-orienting positions when both of said bridge ends have been raised by both of said first electromagnets.

5. A printer according to claim 4 wherein said cylinder lifting bridge carries a mounting block for vertical movement therewith; a lower portion of said rotatable shaft of said type cylinder being slidably received in a guide element; a bearing element being mounted on said shaft and having an outer ring vertically unshiftably disposed on said mounting block so as to mount said type cylinder for vertical movement with said block.

6. A printer according to claim 5 including elastic band means for elastically coupling said bearing element and said block to
permit movement of said type cylinder toward said platen relative to said block, and
return said type cylinder to a non-typing position.

7. A printer according to claim 6 including a ratchet wheel coaxially fixed to said cylinder head shaft; said ratchet wheel having generally V-shaped recesses around the periphery; the number of said recesses corresponding to the number of angular type positions of said type cylinder; a guide spline element fixed on said carriage and being arranged to enter an aligned one of said recesses on said ratchet wheel during printing movement of said type cylinder toward said platen during all three vertical type-orienting positions of said type cylinder to assure proper orientation of a type indicia to be imprinted.

8. A printer according to claim 1 wherein said type-head comprises a cylinder said type cylinder carrying numeral indicia and symbol indicia; said type-head rotating means including return spring means and means for rotating said cylinder head by 180° to change from number indicia to symbol indicia against the bias of said return spring means.

9. A printer according to claim 8 wherein said type-head rotating means includes adjusting means for orienting said type cylinder in a manner suitable for printing symbol indicia when said carriage is in a special predetermined symbol-typing position; said adjusting means being automatically rendered inoperable to orient said type cylinder in a symbol-printing position when said carriage moves out of said special predetermined position.

10. A printer according to claim 8 wherein said type-head rotating means comprises gear means operably connected to said type cylinder shaft to rotate the latter; a vertically movable shift lever with means connected intermediate the ends of the shift lever for rotating said gear means in response to vertical movement of said shift lever; said return spring means biasing said shift lever downwardly; said shift lever including a recess at one end; a lifting peg arranged for vertical movement under the bias of a lifting spring and being connected to means for lowering said peg against the action of said lifting spring; said lifting peg being received in said recess with said lifting peg is in its lower position and with said carriage being at the beginning position of its stroke; said lifting spring which biases said lifting peg upwardly being stronger than said return spring which biases said shift lever downwardly such that with said lifting peg being disposed in said recess, said lifting peg is of sufficient strength to shift said shift lever upwardly and rotate said type cylinder into a symbol-printing position; the length of said lifting peg being such that with said carriage being spaced from said stroke-beginning position said peg and said recess are in disengagement, with said shift lever being held downwardly by said return spring means.

11. A printer according to claim 10 including means for advancing paper that is mounted on said platen, and means for returning said carriage to said stroke-beginning position as paper is being advanced wherein said means for lowering said peg includes meand connected to said paper feeding means for holding said peg in a lowered position while paper is being advanced and said carriage is being returned to its stroke-beginning position.

12. A printer according to claim 10 wherein said means for lowering said peg comprises an electromagnet.

13. A printer according to claim 10 wherein said means for rotating said gear means comprises a sliding head guided for vertical movement on said carriage, said sliding head carrying a rack which is operably connected to said gear means; said sliding head being pivotally connected to said shift lever intermediate the ends of said shift lever; a control arm being flexibly connected to an end of said shift lever located remote from said recess; said control arm being arranged for substantially vertical movement in a plane disposed parallel to said shift lever and being spring-biased to a downward position; said control arm including pulleys at its ends; said second cable means comprising a pair of second cables; said second electromagnet means comprising a pair of second electromagnets; said pair of second cable means being respectively disposed around said pulleys and being actuable by respective ones of said second electromagnets to selectively raise the ends of said control arm to accordingly raise said shift lever and rotate said type cylinder.

14. A printer according to claim 13 including an intermediate block guided for vertical sliding movement on said carriage, said intermediate block having a pin projecting therefrom, said pin being received through a bore of said control arm and an elongated aperture of said shift lever to define the flexible connection therebetween.

15. A printer according to claim 14 wherein said shift lever, in the lowermost positions of said shift lever and said control arm, extends parallel to said control arm along at least two-thirds the length of the latter; the point of pivotal connection between said shift lever and said sliding head being spaced from said peg-receiving recess by a distance approximately equal to two-sevenths of the length of said control arm; the point where said pin passes through said control arm being spaced from an end of said control arm located adjacent said peg-receiving recess by a distance approximately equal to two-thirds of the length of said control arm.

16. A printer according to claim 15 wherein the electromagnets for translatably and rotatably shifting said type cylinder are arranged for control by the output binary signals of an electronic calculator.

17. A printer according to claim 15 wherein the drive configuration of said rack and said gear means is such that when said sliding head is lifted from its lowest to its highest position said type cylinder is rotated by seven-eights of a revolution.

18. A printer according to claim 17 wherein said gear means includes an input gear directly engageable by said rack, and a bevel gear through which said type cylinder shaft is mounted for sliding movement; said bevel gear being mounted on a swivel frame which is rotatable about an axis generally perpendicular to the axis of said type cylinder shaft such that said type cylinder shaft is vertically slidable in said bevel gear, rotatably drivable by said bevel gear, and pivotable with said bevel gear on said swivel frame.

19. A printer according to claim 1 wherein said frame means comprises an iron plate; said electromagnets being mounted on said iron plate; said iron plate having yoke sheets punched therein so as to project upwardly adjacent one of said electromagnets; cover sheets being disposed over said electromagnets and connected to said sheets, said cover sheets including apertures for receiving the armature portions of said electromagnets.

20. A printer according to claim 19 wherein said base frame receives as a unit a sub-frame assembly carrying said carriage.

21. A printer according to claim 1 wherein said electromagnets are identical.

22. A printer according to claim 1 including third cable means connected to said carriage; a first drum around which is wound said third cable means for moving said carriage; a ratchet wheel fixedly connected to said first drum; a feed ratchet engageable with the teeth of said ratchet wheel and being connected to said third electromagnet means to incrementally rotate said ratchet wheel and said drum in response to activation of said third electromagnet means so as to incrementally advance said carriage; and a locking ratchet engageable with said ratchet wheel to restrict backward rotation of the latter; and means for disengaging said feed ratchet and said locking ratchet from said ratchet wheel during return of said carriage to a stroke-beginning position.

23. A printer according to claim 22 including a lever plate rotatably mounted to a stationary frame wall of said frame means; said lever plate including a first generally horizontal lever arm; said third electromagnet means including an armature, said first lever arm, said feed ratchet, and said armature being pivotally connected together about a common axis; a spring being operably braced between said first lever arm and said feed ratchet to bias said feed ratchet against said ratchet wheel; said lever plate including a second lever arm extending downwardly from the rotational axis of said lever plate; said second lever arm carrying a laterally projecting lug; a circular brake ring disposed axially between said second lever arm and said stationary frame wall and disposed peripherally between a pair of limiting strips; said limiting strips being spaced by an amount substantially equal to the diameter of said brake ring; said lug engaging the inner face of said brake ring and being shiftable toward and away from said limiting strips; a spring being attached to a lower portion of said ring to urge said ring downwardly; said brake ring being arranged to brake movement of the lever plate.

24. A printer according to claim 22 wherein said ratchet wheel includes an extension extending from one side thereof; an outer periphery of said extension forming a spirally arranged crank path; a crank arm being pivotally mounted adjacent said crank path with a free end thereof being engageable on said crank path; one end of said crank path being defined by a first stop wall such that engagement between said crank lever and said first stop wall limits movement of said ratchet wheel and said drum in a direction wherein said carriage is advanced; a second stop wall located at the other end of said crank path to limit movement of said drum in a direction wherein said carriage is retracted.

25. A printer according to claim 24 wherein said spiral crank path is greater than 360°

26. A printer according to claim 23 including a toothed strip disposed generally parallel to the path of movement of said carriage; the pitch of the teeth of said toothed strip corresponding to an incremental step of movement of said carriage; said carriage carrying a finger; said toothed strip being mounted for movement toward and away from said finger such that engagement therebetween prevents advancement of said carriage; said lever plate including a third lever arm operably connected by means of a guide rod to said toothed strip to shift said toothed strip toward said finger in response to activation of the electromagnet connected to said lever plate.

27. A printer according to claim 22 including a multi-armed lever mounted on a control shaft for rotation; a first arm of said multi-armed lever being connected to a fourth electromagnet means for rotating said multi-armed lever; a second arm of said multi-armed lever being engageable with a rotatable cam plate; said cam plate being rotatable coaxially with said ratchet wheel and including cam means projecting toward said ratchet wheel; said cam means defining said ratchet disengaging means by being arranged to contact and pivot said feed ratchet and said locking ratchet out of engagement with said ratchet wheel, in response to activation of said fourth electromagnet means.

28. A printer according to claim 27 including a toothed wheel fixed on the axle of said platen; said multi-armed lever including a third arm; a platen-drive ratchet being pivotally mounted on said third arm and being spring-biased into engagement with said toothed wheel to rotate said platen in response to activation of said fourth electromagnet means.

29. A printer according to claim 27 wherein a crank lever is fixed to said control shaft; a peg-carrying lever being pivotally mounted to a stationary frame wall of said frame means; spring means for biasing said peg-carrying lever upwardly; said crank lever carrying a pin that is engageable with said peg-carrying lever; the peg of said peg-carrying lever passing through a slot in said stationary frame wall in the path of travel of said carriage; said carriage having means for rotating said type-head including a shift lever; said shift lever having a forked end and being movable to a lower position wherein said forked end is aligned with said peg; said crank lever being operable to pivot said peg-carrying lever to maintain said peg in alignment with said forked end until engagement occurs therebetween; said last-named spring being operably to lift said peg-carrying lever and said shift arm to rotate said type-head.

30. A printer according to claim 28 including a removable ribbon-carrying container; said container including a felt inking drum around which a ribbon is disposed; means for driving said inking drum in step-by-step fashion such that said ribbon is guided between said platen and said type-head; and deflecting pins for maintaining said ribbon slightly spaced from said platen.

31. A printer according to claim 30 including a push plate pivoted on said third arm of said multi-armed lever; said push plate being guided for essentially horizontal movement on a fixed guide pin; a leaf spring being mounted on said push plate and including a tooth; said tooth extending through an opening in said ribbon-carrying container and drivably engaging notches in said inking drum.

32. A printer according to claim 22 including paper guide means having side walls; a tear-off track being mounted between said side walls; said side walls being rotatable to a position suitable for the feeding of paper wherein the inner side of said tear-off track is spaced from said platen and pressure rolls, normally engaging said platen, are shifted away therefrom.

33. A printer according to claim 32 wherein said side walls include cam surfaces arranged to press said ribbon away from said platen during the insertion of a new strip of paper into the printer.

34. A printer according to claim 1 wherein the ends of each of said first and second cable means are anchored to said frame means; said first and second electromagnet means and said first and second shiftable means each including pulley means; said cable means being wrapped around respective ones of said pulley means intermediate the ends of said first and second cable means.

* * * * *